US010578132B2

(12) United States Patent
Terao et al.

(10) Patent No.: US 10,578,132 B2
(45) Date of Patent: Mar. 3, 2020

(54) FLUID PRESSURE CONTROL DEVICE

(71) Applicant: KYB Corporation, Tokyo (JP)

(72) Inventors: Takeshi Terao, Kanagawa (JP); Keiichi Matsuzaki, Nagano (JP); Hideki Miyashita, Nagano (JP)

(73) Assignee: KYB Corporation, Tokyo (JP)

( * ) Notice: Subject to any disclaimer, the term of this patent is extended or adjusted under 35 U.S.C. 154(b) by 246 days.

(21) Appl. No.: 15/552,538

(22) PCT Filed: Sep. 14, 2015

(86) PCT No.: PCT/JP2015/076049
§ 371 (c)(1),
(2) Date: Aug. 22, 2017

(87) PCT Pub. No.: WO2016/143167
PCT Pub. Date: Sep. 15, 2016

(65) Prior Publication Data

US 2018/0031006 A1 Feb. 1, 2018

(30) Foreign Application Priority Data

Mar. 11, 2015 (JP) ..... 2015-048660

(51) Int. Cl.
*F15B 13/02* (2006.01)
*F15B 11/028* (2006.01)
(Continued)

(52) U.S. Cl.
CPC ..... *F15B 13/024* (2013.01); *F15B 11/028* (2013.01); *F15B 11/16* (2013.01);
(Continued)

(58) Field of Classification Search
CPC ..... F15B 13/024; F15B 13/06; F15B 13/07; F15B 11/16; F15B 2211/50518;
(Continued)

(56) References Cited

U.S. PATENT DOCUMENTS 5,077,972 A * 1/1992 Bianchetta ..... E02F 9/2225 60/427
5,201,176 A * 4/1993 Oshima ..... F15B 11/162 60/422

(Continued)

FOREIGN PATENT DOCUMENTS

JP 2007-239992 A 9/2007

*Primary Examiner* — Michael Leslie
*Assistant Examiner* — Dustin T Nguyen
(74) *Attorney, Agent, or Firm* — Rabin & Berdo, P.C.

(57) ABSTRACT

A fluid pressure control device includes a switching valve that has a pilot chamber to which the working oil is supplied from the supply passage through the second control valve, and a first relief valve that is provided on the downstream side of the switching valve. The second control valve allows supply of the working oil to the pilot chamber in a case where a flow of the working oil to a tilt cylinder is allowed, and blocks the supply of the working oil to the pilot chamber in a case where the flow of the working oil to the tilt cylinder is blocked. The switching valve allows a flow of the working oil to the first relief valve in a case where the working oil is supplied to the pilot chamber, and blocks the flow of the working oil to the first relief valve in a case where the supply of the working oil to the pilot chamber is blocked.

9 Claims, 13 Drawing Sheets

(51) Int. Cl.
*F15B 11/16* (2006.01)
*F15B 13/06* (2006.01)

(52) U.S. Cl.
CPC ..... *F15B 13/06* (2013.01); *F15B 2211/50518* (2013.01); *F15B 2211/50554* (2013.01); *F15B 2211/5157* (2013.01); *F15B 2211/55* (2013.01); *F15B 2211/575* (2013.01); *F15B 2211/7135* (2013.01); *F15B 2211/76* (2013.01)

(58) Field of Classification Search
CPC ..... F15B 2211/55; F15B 2211/575; F15B 2211/5753; F15B 2211/5756; F15B 2211/3116; F15B 2211/6055
USPC ..... 60/484
See application file for complete search history.

(56) References Cited

U.S. PATENT DOCUMENTS

| | | | | |
|---|---|---|---|---|
| 5,873,245 | A * | 2/1999 | Kato | E02F 9/2225 60/445 |
| 6,094,911 | A * | 8/2000 | Crawshaw | E02F 9/2225 60/452 |
| 7,222,484 | B1 | 5/2007 | Dornbach | |
| 2003/0041596 | A1 * | 3/2003 | Flerchinger | F15B 11/028 60/468 |
| 2005/0178116 | A1 * | 8/2005 | Olbrich | F15B 11/165 60/420 |

* cited by examiner

FLUID PRESSURE CONTROL DEVICE

TECHNICAL FIELD

The present invention relates to a fluid pressure control device that controls operation of a fluid pressure actuator.

BACKGROUND ART

JP2007-239992A discloses a fluid pressure control device that independently controls operation of a high pressure actuator and a low pressure actuator while preventing pressure of a pressure limit value or higher from acting on the low pressure actuator.

More specifically, the fluid pressure control device includes a supply passage, first and second control valves, a pressure relief passage, and a relief valve. The supply passage guides a working fluid discharged from a pump to the high pressure actuator (lift cylinder) and the low pressure actuator (tilt cylinder). The first control valve is provided in the supply passage to control the operation of the high pressure actuator. The second control valve is provided in the supply passage to respectively control the operation of the low pressure actuator. The pressure relief passage branches from the supply passage on the upstream side of the first and second control valves and passes through the second control valve. The relief valve is provided in the pressure relief passage.

The second control valve allows a flow of the working fluid in the pressure relief passage in a case where a flow of the working fluid to the low pressure actuator is allowed, and blocks the flow of the working fluid in the pressure relief passage in a case where the flow of the working fluid to the low pressure actuator is blocked. The relief valve allows a flow of the working fluid in a case where a flow of the working fluid to the relief valve is allowed and pressure in the pressure relief passage reaches the pressure limit value, thereby prevents pressure exceeding the pressure limit value from acting on the low pressure actuator.

SUMMARY OF INVENTION

In the fluid pressure control device disclosed in Patent Document 1, in order to efficiently discharge the working fluid from the relief valve, there is a need for increasing a flow passage area of the pressure relief passage. The pressure relief passage is formed in the second control valve. Therefore, size of the second control valve is increased, so that size of the fluid pressure control device is increased.

An object of the present invention is to more downsize a fluid pressure control device that controls operation of a high pressure actuator and a low pressure actuator while preventing pressure of a pressure limit value or higher from acting on the low pressure actuator.

According to one aspect of the present invention, a fluid pressure control device includes a first control valve configured to control work of a high pressure actuator, a second control valve configured to control work of a low pressure actuator, a branching passage branching from a supply passage on the upstream side of a second control valve, a switching valve that is provided in the branching passage and has a pilot chamber to which the working fluid is supplied from the supply passage through the second control valve, and a first relief valve provided on the downstream side of the switching valve. The second control valve allows supply of the working fluid to the pilot chamber in a case where a flow of the working fluid to the low pressure actuator is allowed, and blocks the supply of the working fluid to the pilot chamber in a case where the flow of the working fluid to the low pressure actuator is blocked. The switching valve allows a flow of the working fluid to the first relief valve in a case where the working fluid is supplied to the pilot chamber, and blocks the flow of the working fluid to the first relief valve in a case where the supply of the working fluid to the pilot chamber is blocked. The first relief valve restricts pressure in the supply passage to a first pressure limit value or lower in a case where the flow of the working fluid to the first relief valve is allowed.

DESCRIPTION OF EMBODIMENTS

Figure 1:
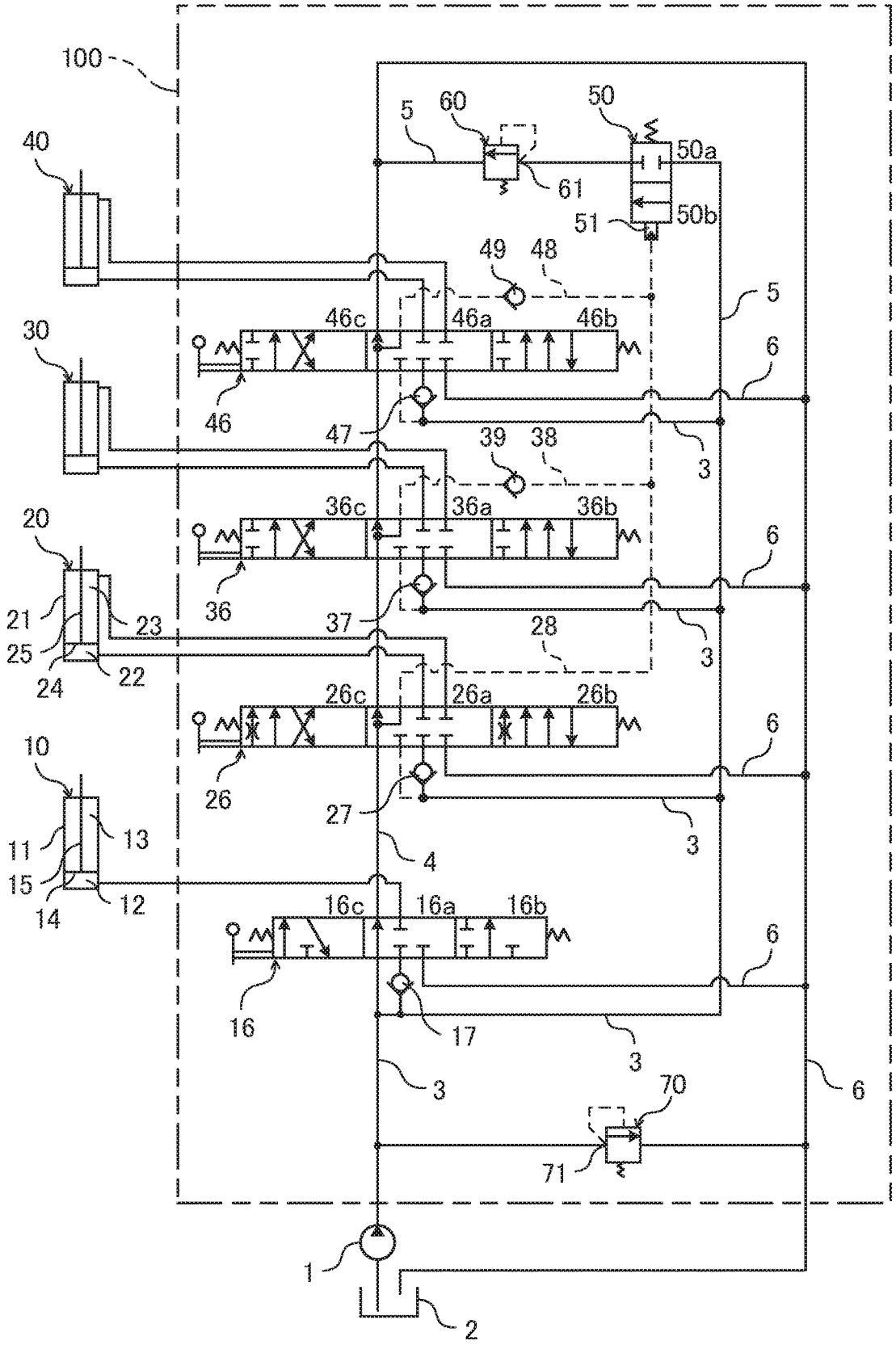
FIG. 1 is a hydraulic circuit diagram of a fluid pressure control device according to a first embodiment of the present invention showing a state where first and second control valves are at neutral positions.

Hereinafter, with reference to the drawings, a fluid pressure control device according to embodiments of the present invention will be described. The fluid pressure control device to be mounted on a forklift will be described. However, the present invention can also be applied to devices other than the forklift.

First Embodiment

Firstly, with reference to FIGS. 1 to 3, a fluid pressure control device 100 according to a first embodiment of the present invention will be described.

The fluid pressure control device 100 controls operation of a lift cylinder 10 that lifts and lowers a fork, a tilt cylinder 20 that changes an inclination angle of a mast, and attached equipment actuators 30, 40 that move other attached equipment. The other attached equipment includes a fork positioner that adjusts intervals of the fork.

Pressure upper limit values are respectively set for the lift cylinder 10, the tilt cylinder 20, and the attached equipment actuators 30, 40, and it is desired that pressure which is higher than the pressure upper limit values does not act on these cylinders 10, 20, 30, 40. Since the lift cylinder 10 brings up the fork and a cargo, the lift cylinder has the pressure upper limit value which is higher than the pressure upper limit values of the tilt cylinder 20 and the attached equipment actuators 30, 40. In the description of the present specification, the lift cylinder 10 is also referred to as a high pressure actuator, and the tilt cylinder 20 and the attached equipment actuators 30, 40 are also referred to as low pressure actuators.

Figure 2:
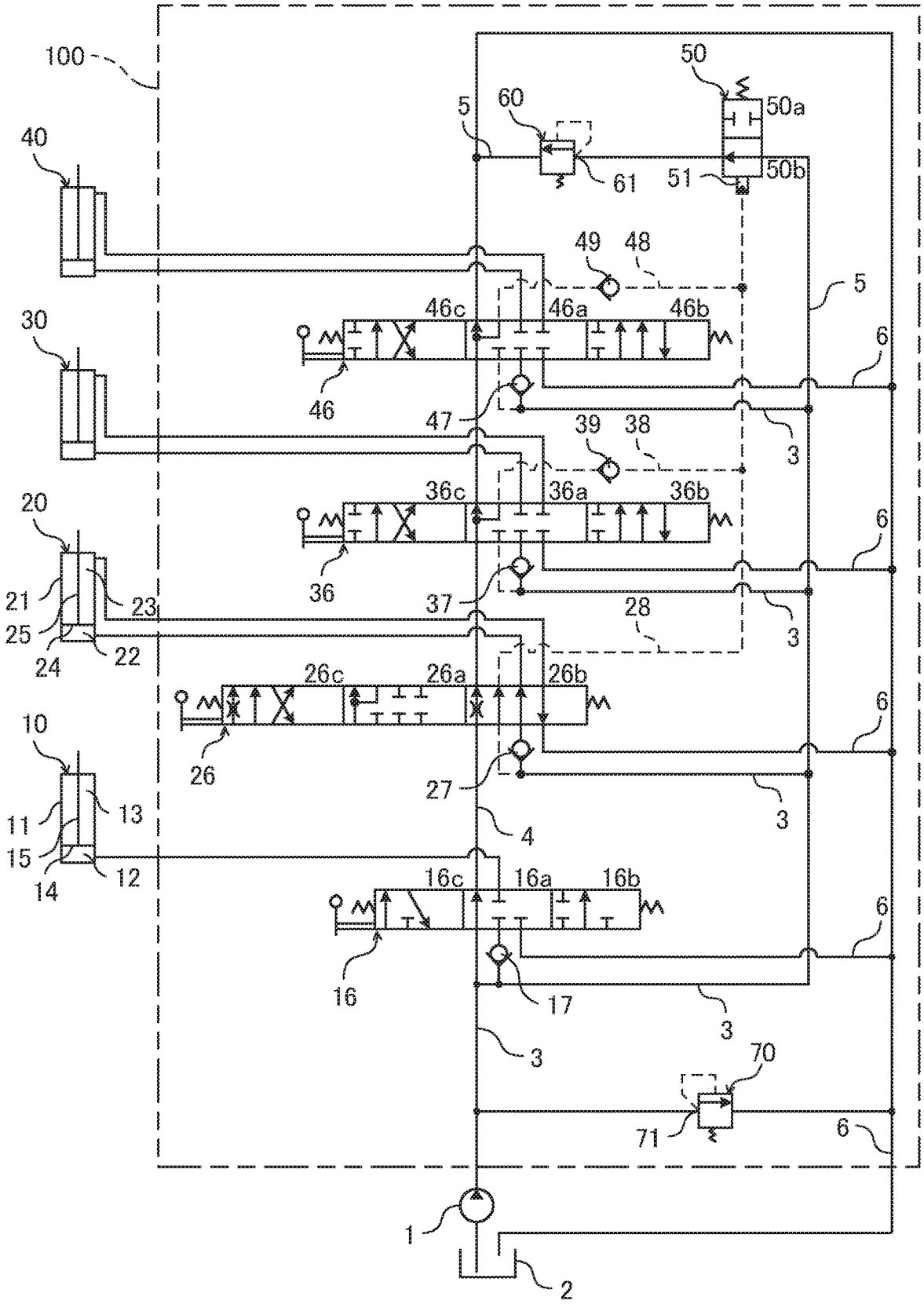
FIG. 2 is a hydraulic circuit diagram of the fluid pressure control device according to the first embodiment of the present invention showing a state where the first control valve is at the neutral position and one of the second control valves is at an operating position.
Figure 3:
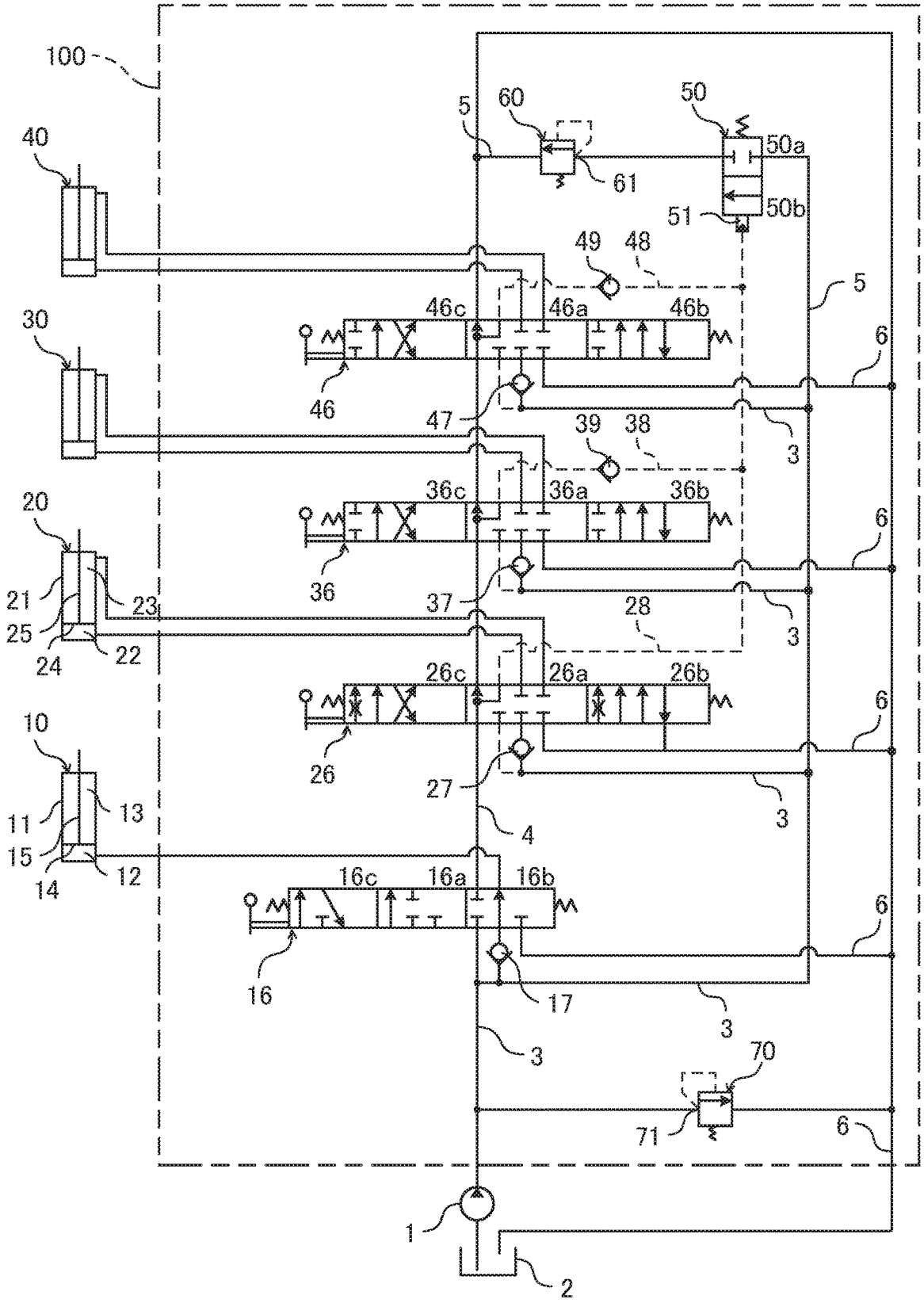
FIG. 3 is a hydraulic circuit diagram of the fluid pressure control device according to the first embodiment of the present invention showing a state where the first control valve is at an operating position and the second control valves is at the neutral positions.

As shown in FIGS. 1 to 3, the fluid pressure control device 100 includes a supply passage 3, a first control valve 16 provided in the supply passage 3, and a plurality of second control valves 26, 36, 46 provided in the supply passage 3. The supply passage 3 guides working oil (working fluid) discharged from a pump 1 serving as a pressurization portion to the lift cylinder 10, the tilt cylinder 20, and the attached equipment actuators 30, 40. The first control valve 16 controls the operation of the lift cylinder 10. The plurality of second control valves 26, 36, 46 respectively controls the operation of the tilt cylinder 20 and the attached equipment actuators 30, 40.

The fluid pressure control device 100 also includes a bypass passage 4 communicating with the supply passage 3 on the upstream side of the first and second control valves 16, 26, 36, 46. In a case where all the first and second control valves 16, 26, 36, 46 are at neutral positions, the bypass passage 4 guides the working oil discharged from the pump 1 to a tank 2 through the first and second control valves 16, 26, 36, 46 and a discharge passage 6.

The lift cylinder 10 is a single-acting cylinder having a piston 14 that partitions an interior of a cylinder tube 11 into a bottom side chamber 12 and a head side chamber 13. A rod 15 is attached to the piston 14. The first control valve 16 is a five-port three-position switching valve having a neutral position 16*a* at which the operation of the lift cylinder 10 is stopped, a lifting position 16*b* at which the rod 15 is lifted, and a lowering position 16*c* at which the rod 15 is lowered. Hereinafter, the lifting position 16*b* will also be referred to as the operating position.

In a case where the first control valve 16 is at the neutral position 16*a*, the first control valve 16 blocks a flow of the working oil in the supply passage 3 and allows a flow of the working oil in the bypass passage 4. In this case, the lift cylinder 10 is not actuated.

In a case where the first control valve 16 is at the lifting position 16*b*, the first control valve 16 allows the flow of the working oil in the supply passage 3 and blocks the flow of the working oil in the bypass passage 4. In this case, the bottom side chamber 12 communicates with the supply passage 3 and the working oil is supplied from the pump 1 to the bottom side chamber 12. As a result, the rod 15 is lifted.

In a case where the first control valve 16 is at the lowering position 16*c*, the first control valve 16 blocks the flow of the working oil in the supply passage 3 and allows the flow of the working oil in the bypass passage 4. In this case, the bottom side chamber 12 communicates with the discharge passage 6 through the first control valve 16, and the working oil in the bottom side chamber 12 is guided to the tank 2 through the first control valve 16 and the discharge passage 6. As a result, the rod 15 is lowered by gravity acting on the piston 14, the rod 15, and the fork.

The tilt cylinder 20 is a double-acting cylinder having a piston 24 that partitions an interior of a cylinder tube 21 into a bottom side chamber 22 and a head side chamber 23. A rod 25 is attached to the piston 24. The second control valve 26 is an eight-port three-position switching valve having a neutral position 26*a* at which the operation of the tilt cylinder 20 is stopped, a forward inclination position 26*b* at which the tilt cylinder 20 is actuated to incline the mast forward, and a rearward inclination position 26*c* at which the tilt cylinder 20 is actuated to incline the mast rearward. Hereinafter, the forward inclination position 26*b* and the rearward inclination position 26*c* will also be referred to as the operating positions.

In a case where the second control valve 26 is at the neutral position 26*a*, the second control valve 26 blocks the flow of the working oil in the supply passage 3 and allows the flow of the working oil in the bypass passage 4. In this case, the tilt cylinder 20 is not actuated.

In a case where the second control valve 26 is at the forward inclination position 26*b*, the second control valve 26 allows the flow of the working oil in the supply passage 3 and restricts the flow of the working oil in the bypass passage 4. In this case, the bottom side chamber 22 communicates with the supply passage 3, and the head side chamber 23 communicates with the discharge passage 6 through the second control valve 26. The working oil is supplied from the pump 1 to the bottom side chamber 22, and the working oil of the head side chamber 23 is discharged to the tank 2. As a result, the rod 25 is moved with respect to the cylinder tube 21, and the mast coupled to the tilt cylinder 20 is inclined forward.

In a case where the second control valve 26 is at the rearward inclination position 26*c*, the second control valve 26 allows the flow of the working oil in the supply passage 3 and restricts the flow of the working oil in the bypass passage 4. In this case, the bottom side chamber 22 communicates with the discharge passage 6 through the second control valve 26, and the head side chamber 23 communicates with the supply passage 3. The working oil is supplied from the pump 1 to the head side chamber 23, and the working oil of the bottom side chamber 22 is discharged to the tank 2. As a result, the rod 25 is moved with respect to the cylinder tube 21, and the mast coupled to the tilt cylinder 20 is inclined rearward.

The attached equipment actuators 30, 40 are double-acting cylinders, and the second control valves 36, 46 are eight-port three-position switching valves. Since structures of the attached equipment actuators 30, 40 and the second control valves 36, 46 are the same as those of the tilt cylinder 20 and the second control valve 26, description thereof will be omitted.

A check valve 17 prevents the working oil of the lift cylinder 10 from flowing to the supply passage 3 in a case where the first control valve 16 is at the neutral position 16*a*. Check valves 27, 37, 47 respectively prevent the working oil of the tilt cylinder 20 and the attached equipment actuators 30, 40 from flowing to the supply passage 3 in a case where the second control valves 26, 36, 46 are at the neutral positions 26*a*, 36*a*, 46*a* as well as the check valve 17.

In the present embodiment, the single-acting cylinder is used as the lift cylinder 10, and the double-acting cylinders are used as the tilt cylinder 20 and the attached equipment actuators 30, 40. However, the present invention is not limited to this mode. The lift cylinder 10 may be a double acting-cylinder or other types of fluid pressure actuators. The tilt cylinder 20 and the attached equipment actuators 30, 40 may be single-acting cylinders or other types of fluid pressure actuators.

The first and second control valves 16, 26, 36, 46 are respectively not limited to the five-port three-position switching valve and the eight-port three-position switching valves but may be other types of valves.

The fluid pressure control device 100 also includes a branching passage 5 branching from the supply passage 3 on the upstream side of the first and second control valves 16, 26, 36, 46, a switching valve 50 provided in the branching passage 5, and a first relief valve 60 provided in the branching passage 5 on the downstream side of the switching valve 50.

The branching passage 5 is connected to the bypass passage 4 while going around the first and second control valves 16, 26, 36, 46. Therefore, in a case where at least one of the first and second control valves 16, 26, 36, 46 blocks the flow of the working oil in the bypass passage 4, the working oil discharged from the pump 1 is guided to the switching valve 50 through the branching passage 5.

The switching valve 50 is a two-port two-position switching valve having a blocking position 50*a* at which a flow of the working oil in the branching passage 5 is blocked, and a communication position 50*b* at which the flow of the working oil in the branching passage 5 is allowed. The switching valve 50 has a pilot chamber 51, and in accordance with supply of the working oil to the pilot chamber 51, the switching valve 50 is switched between the blocking position 50*a* and the communication position 50*b*. Pilot passages 28, 38, 48 respectively connect the pilot chamber 51 and the second control valves 26, 36, 46, and the working oil is supplied from the supply passage 3 to the pilot chamber 51 through the second control valves 26, 36, 46.

In the present embodiment, in a case where the second control valves 26, 36, 46 are at the neutral positions 26*a*, 36*a*, 46*a*, the second control valves separate the pilot passages 28, 38, 48 from the supply passage 3 and connect the pilot passages 28, 38, 48 to the bypass passage 4. That is, in a case where the second control valves 26, 36, 46 are at the neutral positions 26*a*, 36*a*, 46*a*, the second control valves 26, 36, 46 block supply of the working oil from the supply passage 3 to the pilot chamber 51 and allows a flow of the working oil from the pilot chamber 51 to the bypass passage 4.

In a case where the second control valves 26, 36, 46 are at the operating positions 26*b* or 26*c*, 36*b* or 36*c*, 46*b* or 46*c*, respectively, the second control valves 26, 36, 46 connect the pilot passages 28, 38, 48 to the supply passage 3 and separate the pilot passages 28, 38, 48 from the bypass passage 4. That is, in a case where the second control valves 26, 36, 46 are at the operating positions 26*b* or 26*c*, 36*b* or 36*c*, 46*b* or 46*c*, respectively, the second control valves 26, 36, 46 allow the supply of the working oil from the supply passage 3 to the pilot chamber 51 and block the flow of the working oil from the pilot chamber 51 to the bypass passage 4.

A check valve 39 blocks a flow of the working oil from the pilot chamber 51 to the second control valve 36, and a check valve 49 blocks a flow of the working oil from the pilot chamber 51 to the second control valve 46. Instead of providing the check valves 39, 49 in the pilot passages 38, 48, the pilot passages 38, 48 may be preliminarily separated from the bypass passage 4.

No check valve is provided in the pilot passage 28 communicating with the bypass passage 4 on the upstream side of the second control valves 36, 46. This is to prevent the switching valve 50 from being held at the communication position 50*b* by pressure is accumulated in the pilot chamber 51. Even when no check valve is provided in the pilot passage 28 but for example when the second control valve 36 is at the operating position 36*b* or 36*c*, the bypass passage 4 is blocked. Thus, the working oil in the pilot chamber 51 is not discharged to the tank 2 through the pilot chamber 28.

The first relief valve 60 is closed when the pressure in an inlet port 61 of the first relief valve 60 is a first pressure limit value or lower, and opened when the pressure in the inlet port 61 reaches the first pressure limit value. When the first relief valve 60 is opened, the working oil is guided from the branching passage 5 to the bypass passage 4 through the first relief valve 60. Therefore, the pressure in the branching passage 5 is restricted to be the first pressure limit value or lower. That is, the first relief valve 60 restricts the pressure in the branching passage 5 to the first pressure limit value or lower in a case where a flow of the working oil to the first relief valve 60 is allowed.

In the present embodiment, the first relief valve 60 is provided in the branching passage 5. Thus, there is no need for forming flow passages from the supply passage 3 to the first relief valve 60 in each of the second control valves 26, 36, 46. The flow passages from the supply passage 3 to the pilot chamber 51 through the second control valves 26, 36, 46 (pilot passages 28, 38, 48) are only required to be able to flow the amount of the working oil corresponding to the volume of the pilot chamber 51. Thus, an area of the flow passages may be small, so that the second control valves 26, 36, 46 can be downsized. Therefore, the fluid pressure control device 100 can be more downsized.

The fluid pressure control device 100 further includes a second relief valve 70 provided on the upstream side of the switching valve 50. The second relief valve 70 restricts the pressure in the supply passage 3 to a second pressure limit value or lower which is higher than the first pressure limit value.

More specifically, the second relief valve 70 is closed when the pressure in an inlet port 71 of the second relief valve 70 is the second pressure limit value or lower, and opened when the pressure in the inlet port 71 reaches the second pressure limit value. When the second relief valve 70 is opened, the working oil is guided from the supply passage 3 to the bypass passage 4 through the second relief valve 70. Therefore, the pressure in the supply passage 3 is restricted to be the second pressure limit value or lower.

In the embodiment shown in FIGS. 1 to 3, the second relief valve 70 is provided in a flow passage branching from the supply passage 3. However, the second relief valve 70 may be provided in a flow passage branching from the branching passage 5 on the upstream side of the switching valve 50.

Next, operation of the fluid pressure control device 100 will be described.

Firstly, a case where at least one of the second control valves 26, 36, 46 is at the operating position 26*b*, 26*c*, 36*b*, 36*c*, 46*b*, or 46*c* (see FIG. 2) will be described.

In a case where the second control valve 26 is at the forward inclination position 26*b*, that is, in a case where the second control valve 26 allows a flow of the working oil to the tilt cylinder 20, the second control valve 26 allows the supply of the working oil from the supply passage 3 to the pilot chamber 51. Since the check valves 39, 49 block the flow of the working oil from the pilot chamber 51 to the second control valves 36, 46, the working oil is supplied to the pilot chamber 51, and the switching valve 50 is switched to the communication position 50*b*. The switching valve 50 allows the flow of the working oil in the branching passage 5. As a result, the flow of the working oil to the first relief valve 60 is allowed.

Since the branching passage 5 communicates with the supply passage 3, the first relief valve 60 restricts the pressure in the branching passage 5 and the supply passage 3 to the first limit value or lower. Therefore, even when the tilt cylinder 20 communicates with the supply passage 3, the pressure exceeding the first pressure limit value can be prevented from acting on the tilt cylinder 20.

By setting the first pressure limit value to the pressure upper limit value of the tilt cylinder 20 or lower, the pressure exceeding the pressure upper limit value of the tilt cylinder 20 does not act on the tilt cylinder 20. As a result, damage to the tilt cylinder 20 can be prevented.

In such a way, in the present embodiment, in a case where the second control valve 26 allows the flow of the working oil to the tilt cylinder 20, the second control valve 26 allows the supply of the working oil to the pilot chamber 51. Thus, the working oil is supplied to the pilot chamber 51. As a result, the switching valve 50 allows the flow of the working oil to the first relief valve 60, and the first relief valve 60 restricts the pressure in the branching passage 5 to the first pressure limit value or lower. Since the branching passage 5 communicates with the supply passage 3, the pressure in the supply passage 3 is restricted to be the first pressure limit value or lower by the first relief valve 60. Therefore, the pressure exceeding the first pressure limit value can be prevented from acting on the tilt cylinder 20.

In a case where the second control valves 36, 46 are at the operating positions 36*b* or 36*c*, 46*b* or 46*c*, respectively, as well as a case where the second control valve 26 is at the operating position 26*b* or 26*c*, the pressure exceeding the first pressure limit value can be prevented from acting on the attached equipment actuators 30, 40. Therefore, damage to the attached equipment actuators 30, 40 can be prevented.

The pressure in the supply passage 3 is restricted to be the first pressure limit value or lower irrespective of the position of the first control valve 16. Therefore, even in a case where the high pressure actuator 10 and at least one of the low pressure actuators 20, 30, 40 are actuated, the pressure exceeding the first pressure limit value can be prevented from acting on the low pressure actuators 20, 30, 40.

Next, a case where all the second control valves 26, 36, 46 are at the neutral positions 26*a*, 36*a*, 46*a* (see FIG. 3) will be described.

In a case where the second control valve 26 is at the neutral position 26*a*, that is, in a case where the second control valve 26 blocks the flow of the working oil to the tilt cylinder 20, the second control valve 26 blocks the supply of the working oil from the supply passage 3 to the pilot chamber 51. In this case, the second control valve 26 allows the flow of the working oil from the pilot chamber 51 to the bypass passage 4. In a case where the second control valves 36, 46 are at the neutral positions 36*a*, 46*a*, the second control valves 36, 46 block the supply of the working oil from the supply passage 3 to the pilot chamber 51 as well as the second control valve 26.

In a case where all the second control valves 26, 36, 46 are at the neutral positions 26*a*, 36*a*, 46*a*, the pilot chamber 51 communicates with the tank 2 through the bypass passage 4 and the discharge passage 6. Therefore, the working oil is not supplied to the pilot chamber 51, and the switching valve 50 is switched to the blocking position 50*a*. At the blocking position 50*a*, the flow of the working oil in the branching passage 5 is blocked. As a result, the flow of the working oil to the first relief valve 60 is blocked.

Since the working oil does not flow to the first relief valve 60, the pressure in the supply passage 3 is not restricted by the first pressure limit value. That is, the pressure of the supply passage 3 can be increased more than the first pressure limit value. Therefore, when the first control valve 16 is switched to the lifting position 16*b* and the lift cylinder 10 is extended, the pressure exceeding the first pressure limit value can act on the lift cylinder 10.

A flow of the working oil from the supply passage 3 to the second relief valve 70 is not blocked irrespective of the positions of the first and second control valves 16, 26, 36, 46. Therefore, the pressure in the supply passage 3 is restricted to be the second pressure limit value or lower. Even when the lift cylinder 10 communicates with the supply passage 3, the pressure exceeding the second pressure limit value can be prevented from acting on the lift cylinder 10.

In such a way, in the present embodiment, the second relief valve 70 is provided on the upstream side of the switching valve 50. Thus, the pressure in the supply passage 3 is restricted to be the second pressure limit value or lower by the second relief valve 70. Therefore, even in a case where the first relief valve 60 does not restrict the pressure in the supply passage 3, the pressure of the second pressure limit value or higher can be prevented from acting on the lift cylinder 10.

By setting the second pressure limit value to the pressure upper limit value of the lift cylinder 10 or lower, the pressure exceeding the pressure upper limit value of the lift cylinder 10 does not act on the lift cylinder 10. As a result, damage to the lift cylinder 10 can be prevented.

Although the fluid pressure control device 100 according to the present embodiment includes the one first control valve 16 that controls the operation of the one high pressure actuator 10, the fluid pressure control device 100 is not limited to this mode. The fluid pressure control device 100 may include a plurality of first control valves that respectively control operation of a plurality of high pressure actuators.

The fluid pressure control device 100 includes the plurality of second control valves 26, 36, 46 that control the operation of the plurality of low pressure actuators 20, 30, 40, respectively. However, the fluid pressure control device 100 may include one second control valve 26 that controls operation of one low pressure actuator.

Further, the branching passage 5 may branch from the supply passage 3 on the downstream side of the first control valve 16 and on the upstream side of the second control valves 26, 36, 46 and go around the second control valves 26, 36, 46.

According to the above first embodiment, the following effects are obtained.

Since the first relief valve 60 is provided in the branching passage 5, there is no need for forming flow passages from the supply passage 3 to the first relief valve 60 in each of the second control valves 26, 36, 46. The flow passages running from the supply passage 3 to the pilot chamber 51 through the second control valves 26, 36, 46 are only required to be able to flow the amount of the working oil corresponding to the volume of the pilot chamber 51. Thus, an area of the flow passages may be small, so that the second control valves 26, 36, 46 can be respectively downsized. Therefore, the fluid pressure control device 100 can be more downsized.

In a case where the second control valve 26 allows the flow of the working oil to the tilt cylinder 20, the working oil is supplied to the pilot chamber 51. Thus, the switching valve 50 allows the flow of the working oil in the branching passage 5. The flow of the working oil to the first relief valve 60 is allowed, and the pressure in the branching passage 5 and the supply passage 3 is restricted to be the first pressure limit value or lower by the first relief valve 60. Therefore, even when the tilt cylinder 20 communicates with the supply passage 3, the pressure exceeding the first pressure limit value can be prevented from acting on the tilt cylinder 20.

The second relief valve 70 is provided on the upstream side of the switching valve 50. Thus, even when the switching valve 50 blocks the flow of the working oil in the branching passage 5, the pressure in the supply passage 3 is restricted to be the second pressure limit value or lower by using the second relief valve 70. Therefore, even when the lift cylinder 10 communicates with the supply passage 3, the pressure exceeding the second pressure limit value can be prevented from acting on the lift cylinder 10.

Second Embodiment

Next, with reference to FIG. 4, a fluid pressure control device 200 according to a second embodiment of the present invention will be described. The same configurations as the configurations in the first embodiment will be given the same reference signs, and description thereof will be omitted.

Figure 4:
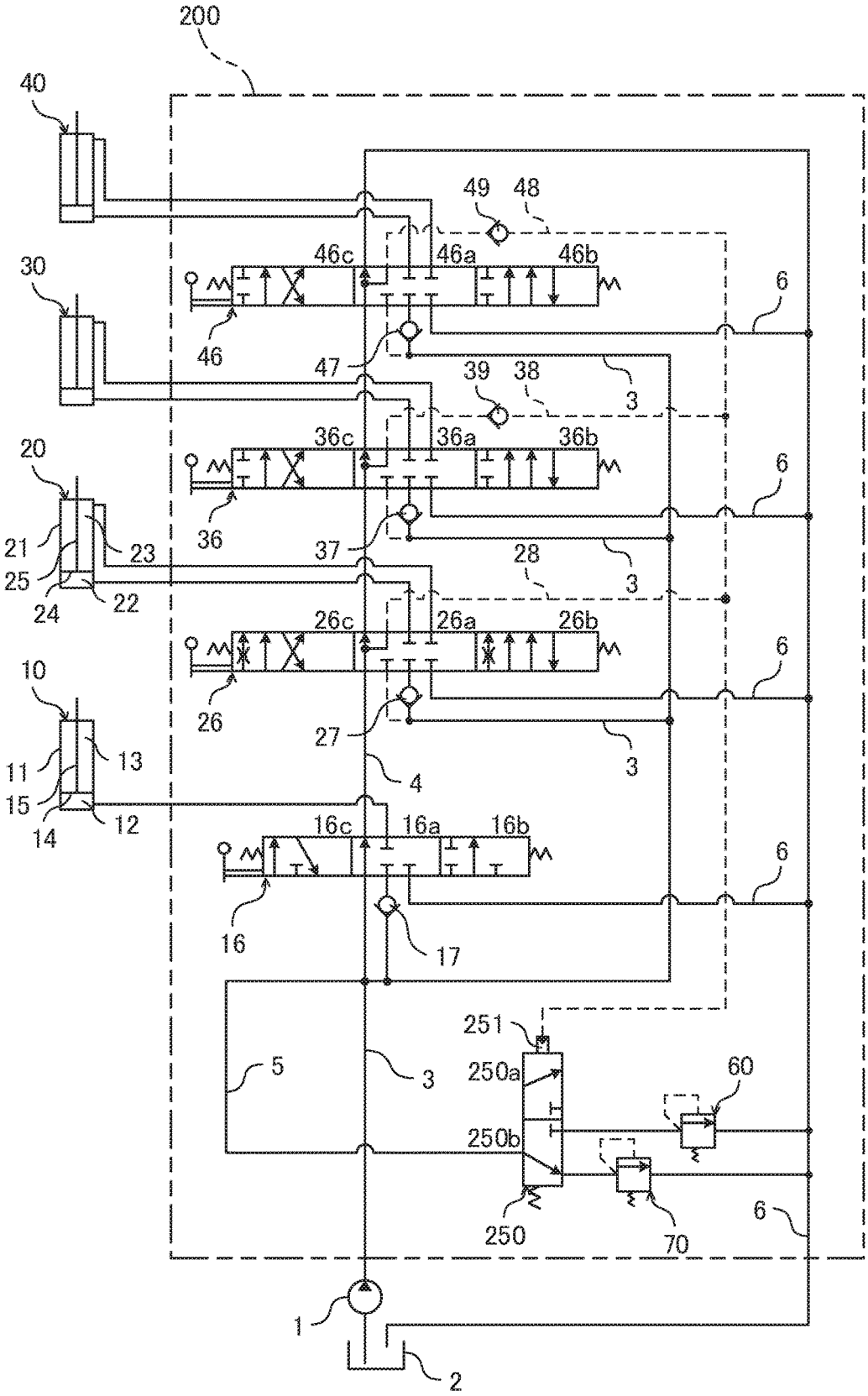
FIG. 4 is a hydraulic circuit diagram of a fluid pressure control device according to a second embodiment of the present invention.

As shown in FIG. 4, a second relief valve 70 is provided in a branching passage 5 on the downstream side of a switching valve 250. The second relief valve 70 restricts the pressure in the branching passage 5 to a second pressure limit value or lower in a case where a flow of the working oil to the second relief valve 70 is allowed. The second pressure limit value is higher than a first pressure limit value.

The switching valve 250 is a three-port two-position switching valve having a first communication position 250*a* at which the working oil in the branching passage 5 is guided to a first relief valve 60, and a second communication position 250*b* at which a flow of the working oil in the branching passage 5 is guided to the second relief valve 70. The switching valve 250 blocks the flow of the working oil to the second relief valve 70 in a case where the switching valve 250 is at the first communication position 250*a*, and blocks a flow of the working oil to the first relief valve 60 in a case where the switching valve 250 is at the second communication position 250*b*.

The switching valve 250 has a pilot chamber 251, and in accordance with supply of the working oil to the pilot chamber 251, the switching valve 250 is switched between the first communication position 250*a* and the second communication position 250*b*. The pilot chamber 251 is respectively connected to second control valves 26, 36, 46, and the working oil is supplied from a supply passage 3 to the pilot chamber 251 through the second control valves 26, 36, 46.

In a case where the working oil is supplied to the pilot chamber 251, the switching valve 250 guides the working oil to the first relief valve 60 and blocks the flow of the working oil to the second relief valve 70. Therefore, the first relief valve 60 restricts the pressure in the branching passage 5 to the first pressure limit value or lower. Since the branching passage 5 is connected to the supply passage 3, the pressure in the supply passage 3 is restricted to be the first pressure limit value or lower by the first relief valve 60.

In a case where the supply of the working oil to the pilot chamber 251 is blocked, the switching valve 250 blocks the flow of the working oil to the first relief valve 60 and guides the working oil to the second relief valve 70. Therefore, the second relief valve 70 restricts the pressure in the branching passage 5 to the second pressure limit value or lower. Since the branching passage 5 is connected to the supply passage 3, the pressure in the supply passage 3 is restricted to be the second pressure limit value or lower by the second relief valve 70.

Next, operation of the fluid pressure control device 200 will be described.

Firstly, a case where at least one of the second control valves 26, 36, 46 is at an operating position 26*b*, 26*c*, 36*b*, 36*c*, 46*b*, or 46*c* will be described.

In a case where the second control valve 26 is at the operating position 26*b* or 26*c*, that is, in a case where the second control valve 26 allows a flow of the working oil to a tilt cylinder 20, the second control valve 26 allows supply of the working oil from the supply passage 3 to the pilot chamber 251. By supplying the working oil to the pilot chamber 251, the switching valve 250 is switched to the first communication position 250*a*. The switching valve 250 guides the working oil to the first relief valve 60 and blocks the flow of the working oil to the second relief valve 70.

Since the working oil is guided to the first relief valve 60, the pressure in the branching passage 5 and the supply passage 3 is restricted to be the first pressure limit value or lower by the first relief valve 60. Therefore, even when the tilt cylinder 20 communicates with the supply passage 3, the pressure exceeding the first pressure limit value can be prevented from acting on the tilt cylinder 20.

In a case where the second control valves 36, 46 are at the operating positions 36*b* or 36*c*, 46*b* or 46*c*, respectively, as well as a case where the second control valve 26 is at the operating position 26*b* or 26*c*, the pressure exceeding the first pressure limit value can be prevented from acting on attached equipment actuators 30, 40.

The pressure in the supply passage 3 is restricted to be the first pressure limit value or lower irrespective of a position of a first control valve 16. Therefore, even in a case where the high pressure actuator 10 and at least one of the low pressure actuators 20, 30, 40 are actuated, the pressure exceeding the first pressure limit value can be prevented from acting on the low pressure actuators 20, 30, 40.

Next, a case where all the second control valves 26, 36, 46 are at neutral positions 26*a*, 36*a*, 46*a* will be described.

In a case where the second control valve 26 is at the neutral position 26*a*, that is, in a case where the second control valve 26 blocks the flow of the working oil to the tilt cylinder 20, the second control valve 26 blocks the supply of the working oil from the supply passage 3 to the pilot chamber 251. At this time, the second control valve 26 provides communication between the pilot chamber 251 and a bypass passage 4. In a case where the second control valves 36, 46 are at the neutral positions 36*a*, 46*a*, the second control valves 36, 46 block the supply of the working oil to the pilot chamber 251.

When all the second control valves 26, 36, 46 are at the neutral positions 26*a*, 36*a*, 46*a*, respectively, the pilot chamber 251 communicates with a tank 2 through the bypass passage 4 and a discharge passage 6. Therefore, the working oil is not supplied to the pilot chamber 251, and the switching valve 250 is switched to the second communication position 250*b*. At the second communication position 250*b*, the working oil is guided to the second relief valve 70 and the flow of the working oil to the first relief valve 60 is blocked.

Since the working oil does not flow to the first relief valve 60, the pressure in the supply passage 3 is not restricted by the first pressure limit value. That is, the pressure in the supply passage 3 can be increased more than the first pressure limit value. Therefore, when the first control valve 16 is switched to a lifting position 16*b* and a lift cylinder 10 is extended, the pressure exceeding the first pressure limit value can act on the lift cylinder 10.

Since the flow of the working oil to the second relief valve 70 is allowed, the pressure in the supply passage 3 is restricted to be the second pressure limit value or lower. Therefore, even when the lift cylinder 10 communicates with the supply passage 3, the pressure exceeding the second pressure limit value can be prevented from acting on the lift cylinder 10.

According to the above second embodiment, in addition to the effects obtained in the first embodiment, the following effects are obtained.

In the present embodiment, the first and second relief valves 60, 70 are provided in the branching passage 5. Thus, in comparison to a case where the second relief valve 70 is provided in a flow passage different from the branching passage 5, a space of the flow passages from the supply passage 3 to the first and second relief valves 60, 70 is small. Therefore, the fluid pressure control device 200 can be more downsized.

Since the switching valve 250 switches the direction of the flow of the working oil, the pressure in the supply passage 3 is restricted to be the first or second pressure limit value or lower. Therefore, the pressure of the first pressure limit value or higher can be prevented from acting on the tilt cylinder 20 and the attached equipment actuators 30, 40, and the pressure of the second pressure limit value or higher can be prevented from acting on the lift cylinder 10.

Third Embodiment

Next, with reference to FIG. 5, a fluid pressure control device 300 according to a third embodiment of the present invention will be described. The same configurations as the configurations in the first and second embodiments will be given the same reference signs, and description thereof will be omitted.

Figure 5:
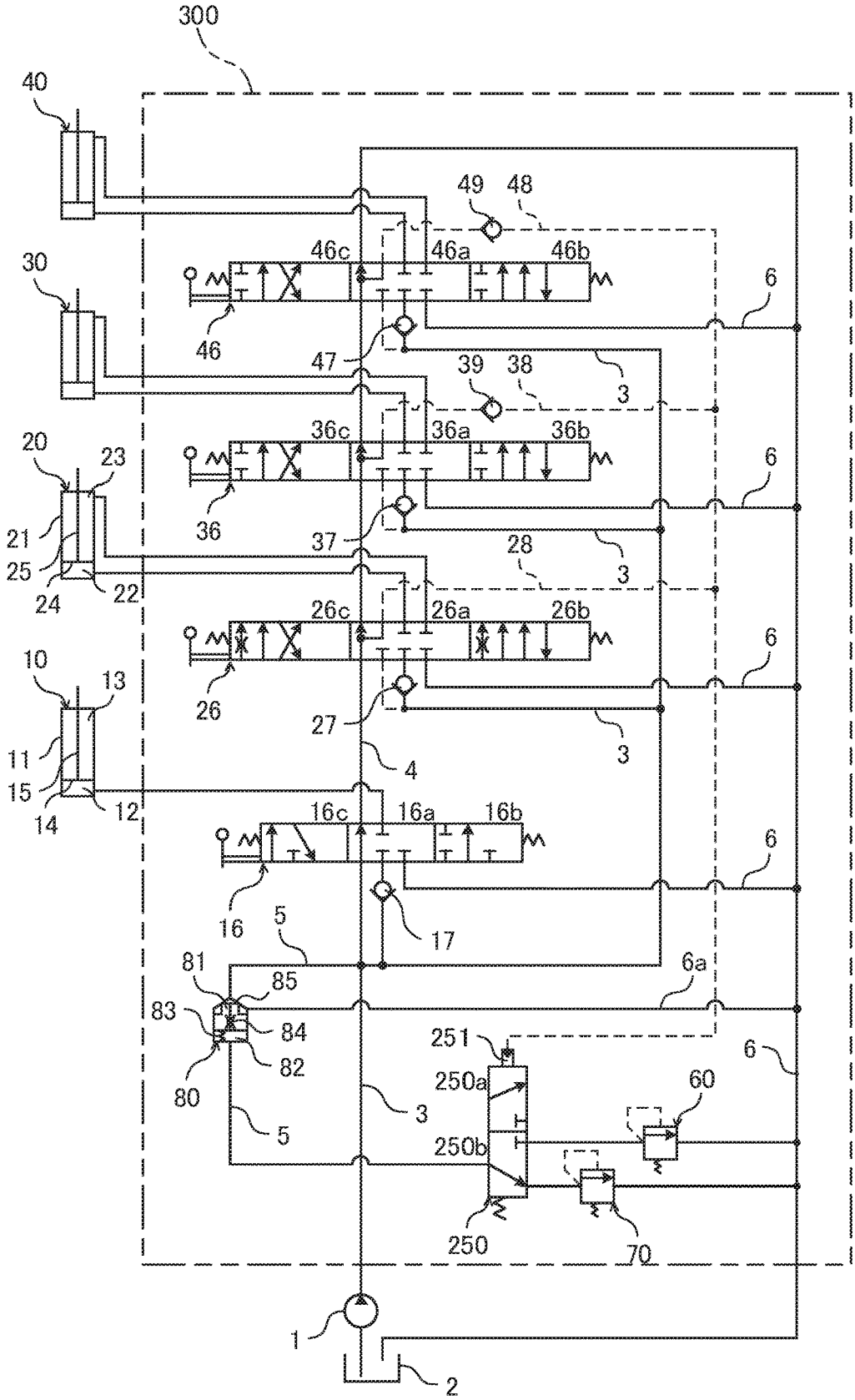
FIG. 5 is a hydraulic circuit diagram of a fluid pressure control device according to a third embodiment of the present invention.

As shown in FIG. 5, a second relief valve 70 is provided in a branching passage 5 on the downstream side of a switching valve 250. The second relief valve 70 restricts the pressure in the branching passage 5 to a second pressure limit value or lower in a case where a flow of the working oil to the second relief valve 70 is allowed. The second pressure limit value is higher than a first pressure limit value.

The switching valve 250 is a three-port two-position switching valve having a first communication position 250*a* at which the working oil in the branching passage 5 is guided to a first relief valve 60, and a second communication position 250*b* at which a flow of the working oil in the branching passage 5 is guided to the second relief valve 70. The switching valve 250 blocks the flow of the working oil to the second relief valve 70 in a case where the switching valve 250 is at the first communication position 250*a*, and blocks a flow of the working oil to the first relief valve 60 in a case where the switching valve 250 is at the second communication position 250*b*.

The switching valve 250 has a pilot chamber 251, and in accordance with supply of the working oil to the pilot chamber 251, the switching valve 250 is switched between the first communication position 250*a* and the second communication position 250*b*. The pilot chamber 251 is respectively connected to second control valves 26, 36, 46, and the working oil is supplied from a supply passage 3 to the pilot chamber 251 through the second control valves 26, 36, 46.

In a case where the working oil is supplied to the pilot chamber 251, the switching valve 250 guides the working oil to the first relief valve 60 and blocks the flow of the working oil to the second relief valve 70. Therefore, the pressure in the branching passage 5 is restricted to be the first pressure limit value or lower by the first relief valve 60.

In a case where the supply of the working oil to the pilot chamber 251 is blocked, the switching valve 250 blocks the flow of the working oil to the first relief valve 60 and guides the working oil to the second relief valve 70. Therefore, the pressure in the branching passage 5 is restricted to be the second pressure limit value or lower by the second relief valve 70.

The fluid pressure control device 300 further includes an unloading valve 80 provided in the branching passage 5 on the upstream side of the switching valve 250. The unloading valve 80 is connected to a discharge passage 6*a* through which the working oil is guided to the discharge passage 6 while going around the switching valve 250. At the time of valve open, the unloading valve 80 guides the working oil from the branching passage 5 to the discharge passage 6*a*.

The unloading valve 80 has a valve body 81, a back pressure chamber 82 provided facing a back surface of the valve body 81, a spring 83 housed in the back pressure chamber 82, and a throttle 84 provided in the valve body 81. The throttle 84 communicates with the back pressure chamber 82, and the back pressure chamber 82 communicates with the switching valve 250 through the branching passage 5. Therefore, the working oil of the supply passage 3 is guided to the switching valve 250 through the throttle 84 and the back pressure chamber 82.

The spring 83 biases the valve body 81 in the valve closing direction. Therefore, pressure in the back pressure chamber 82 and bias force of the spring 83 act in the direction in which the valve body 81 is seated on a seat portion 85.

In a case where a load acting on the valve body 81 by the pressure in the supply passage 3 is smaller than a load acting on the valve body 81 by the pressure in the back pressure chamber 82 and the bias force of the spring 83, the valve body 81 is seated on the seat portion 85 and blocks a flow of the working oil from the branching passage 5 to the discharge passage 6*a*. In a case where the load acting on the valve body 81 by the pressure in the supply passage 3 is greater than the load acting on the valve body 81 by the pressure in the back pressure chamber 82 and the bias force of the spring 83, the valve body 81 is taken away from the seat portion 85 and allows the flow of the working oil from the branching passage 5 to the discharge passage 6*a*. In such a way, the valve body 81 is opened/closed in accordance with the pressure in the back pressure chamber 82.

Next, operation of the fluid pressure control device 300 will be described.

Firstly, a case where at least one of the second control valves 26, 36, 46 is at an operating position 26*b*, 26*c*, 36*b*, 36*c*, 46*b*, or 46*c*, respectively, will be described.

In a case where the second control valve 26 is at the operating position 26*b* or 26*c*, that is, in a case where the second control valve 26 allows a flow of the working oil to a tilt cylinder 20, the second control valve 26 allows supply of the working oil from the supply passage 3 to the pilot chamber 251. By supplying the working oil to the pilot chamber 251, the switching valve 250 is switched to the first communication position 250*a*. The switching valve 250 guides the working oil to the first relief valve 60 and blocks the flow of the working oil to the second relief valve 70. Since the working oil is guided to the first relief valve 60, the pressure in the first relief valve 60 acts on the back pressure chamber 82.

In a case where the pressure in the supply passage 3 is the first pressure limit value or lower, the first relief valve 60 is closed, so that pressure equal to the pressure in the supply passage 3 acts on the back pressure chamber 82. The load acting on the valve body 81 by the pressure in the supply passage 3 is smaller than the load acting on the valve body 81 by the pressure in the back pressure chamber 82 and the bias force of the spring 83, and the valve body 81 is brought into a valve closed state.

When the pressure in the supply passage 3 reaches the first pressure limit value, the first relief valve 60 is opened, and the working oil in the back pressure chamber 82 flows to a tank 2 through the first relief valve 60. Since the working oil in the supply passage 3 passes through the throttle 84 and is supplied to the back pressure chamber 82, the pressure in the back pressure chamber 82 becomes lower than the pressure in the supply passage 3. The load acting on the valve body 81 by the pressure in the supply passage 3 becomes greater than the load acting on the valve body 81 by the pressure in the back pressure chamber 82 and the bias force of the spring 83, and the valve body 81 is brought into a valve opened state. The working oil in the supply passage 3 flows to the discharge passage 6*a* through the unloading valve 80, so that the pressure of the supply passage 3 is lowered.

In such a way, the pressure in the supply passage 3 is restricted to be the first pressure limit value or lower by the unloading valve 80. Therefore, even when the tilt cylinder 20 communicates with the supply passage 3, the pressure exceeding the first pressure limit value can be prevented from acting on the tilt cylinder 20.

In a case where the second control valves 36, 46 are at the operating positions 36*b* or 36*c*, 46*b* or 46*c*, respectively, as well as the second control valve 26, the pressure exceeding the first pressure limit value can be prevented from acting on attached equipment actuators 30, 40.

The pressure in the supply passage 3 is restricted to be the first pressure limit value or lower irrespective of a position of a first control valve 16. Therefore, even in a case where the high pressure actuator 10 and at least one of the low pressure actuators 20, 30, 40 are actuated, the pressure exceeding the first pressure limit value can be prevented from acting on the low pressure actuators 20, 30, 40.

Next, a case where all the second control valves 26, 36, 46 are at neutral positions 26*a*, 36*a*, 46*a* will be described.

In a case where the second control valve 26 is at the neutral position 26*a*, that is, in a case where the second control valve 26 blocks the flow of the working oil to the tilt cylinder 20, the second control valve 26 blocks the supply of the working oil from the supply passage 3 to the pilot chamber 251. At this time, the second control valve 26 provides communication between the pilot chamber 251 and a bypass passage 4. In a case where the second control valves 36, 46 are at the neutral positions 36*a*, 46*a*, the second control valves 36, 46 block the supply of the working oil to the pilot chamber 251.

When all the second control valves 26, 36, 46 are at the neutral positions 26*a*, 36*a*, 46*a*, the pilot chamber 251 communicates with the tank 2 through the bypass passage 4 and a discharge passage 6. Therefore, the working oil is not supplied to the pilot chamber 251, and the switching valve 250 is switched to the second communication position 250*b*. At the second communication position 250*b*, the working oil is guided to the second relief valve 70 and the flow of the working oil to the first relief valve 60 is blocked. Since the working oil is guided to the second relief valve 70, the pressure in the second relief valve 70 acts on the back pressure chamber 82.

In a case where the pressure in the supply passage 3 is the second pressure limit value or lower, the second relief valve 70 is closed, so that pressure equal to the pressure in the supply passage 3 acts on the back pressure chamber 82. Therefore, the load acting on the valve body 81 by the pressure in the supply passage 3 is smaller than the load acting on the valve body 81 by the pressure in the back pressure chamber 82 and the bias force of the spring 83, and the valve body 81 is brought into a valve closed state.

When the pressure in the supply passage 3 reaches the second pressure limit value, the second relief valve 70 is opened, and the working oil in the back pressure chamber 82 flows to the tank 2 through the second relief valve 70. Since the working oil in the supply passage 3 passes through the throttle 84 and is supplied to the back pressure chamber 82, the pressure in the back pressure chamber 82 becomes lower than the pressure in the supply passage 3. As a result, the load acting on the valve body 81 by the pressure in the supply passage 3 becomes greater than the load acting on the valve body 81 by the pressure in the back pressure chamber 82 and the bias force of the spring 83, and the valve body 81 is brought into a valve opened state. The working oil in the supply passage 3 flows to the discharge passage 6*a* through the unloading valve 80, so that the pressure of the supply passage 3 is lowered.

In such a way, the pressure in the supply passage 3 is restricted to be the second pressure limit value or lower by the unloading valve 80. Therefore, even when a lift cylinder 10 communicates with the supply passage 3, the pressure exceeding the second pressure limit value can be prevented from acting on the lift cylinder 10.

According to the above third embodiment, in addition to the effects obtained in the first embodiment, the following effects are obtained.

The valve body 81 is opened/closed in accordance with the pressure in the back pressure chamber 82 to allow or block the flow of the working oil from the branching passage 5 to the discharge passage 6*a*. A part of the branching passage 5 on the downstream side of the unloading valve 80 is only required to be able to transmit the pressure in the first and second relief valves 60, 70 to the back pressure chamber 82. Thus, an area of the flow passage may be small. The unloading valve 80 guides the working oil from the branching passage 5 to the discharge passage 6*a* while going around the switching valve 250 at the time of valve open. The working oil guided from the supply passage 3 to the branching passage 5 is discharged to the tank 2 mainly through the discharge passages 6*a*, 6 at the time of valve open of the unloading valve 80. Thus, the area of the flow passage in the part of the branching passage 5 on the downstream side of the unloading valve 80 may be small. Therefore, the fluid pressure control device 300 can be more downsized.

Fourth Embodiment

Next, with reference to FIG. 6, a fluid pressure control device 400 according to a fourth embodiment of the present invention will be described. The same configurations as the configurations in the first embodiment will be given the same reference signs, and description thereof will be omitted.

Figure 6:
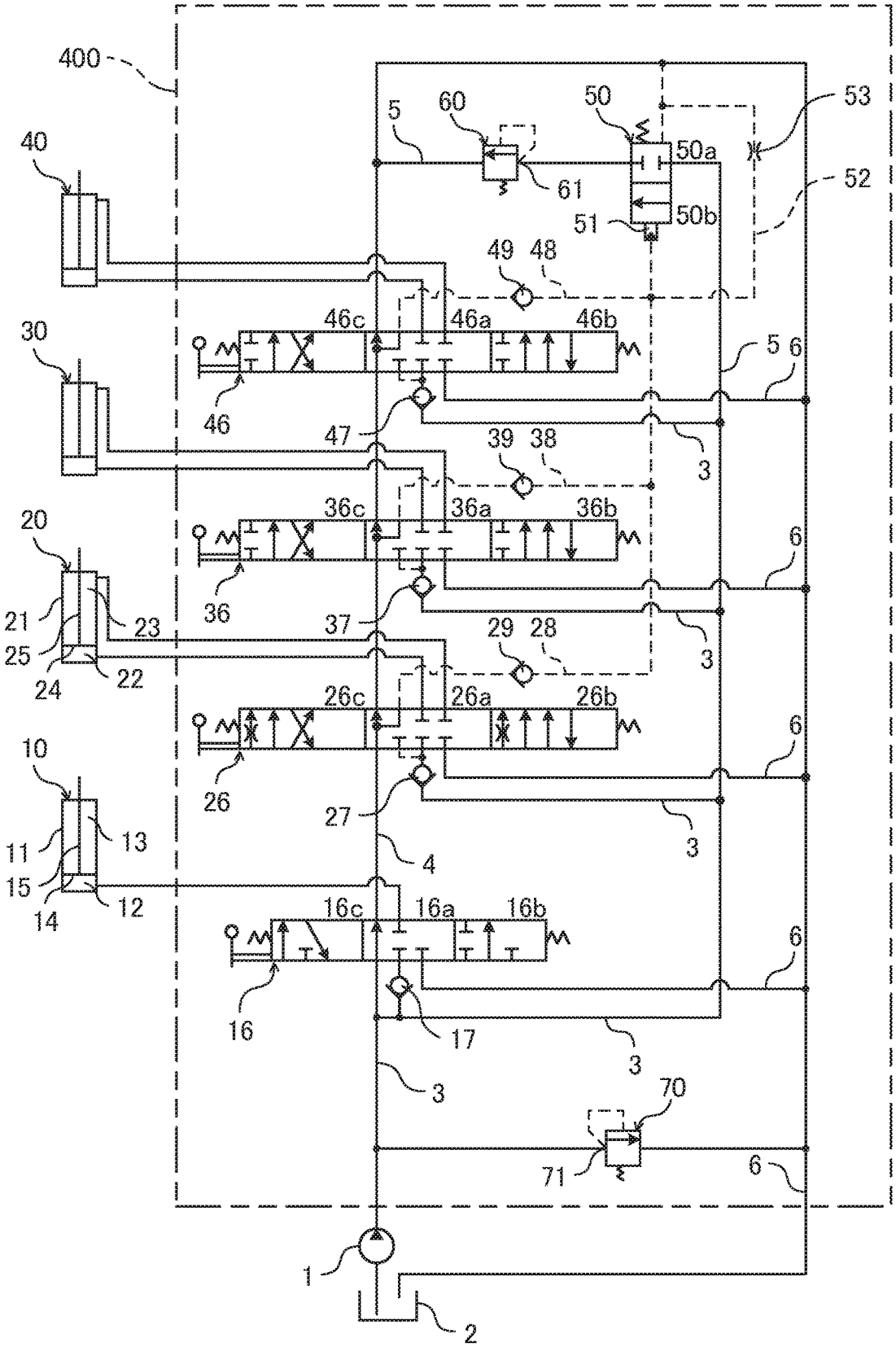
FIG. 6 is a hydraulic circuit diagram of a fluid pressure control device according to a fourth embodiment of the present invention.

As shown in FIG. 6, the fluid pressure control device 400 includes a check valve 29 provided in a pilot passage 28. The check valve 29 allows a flow of the working oil from a second control valve 26 to a pilot chamber 51 in the pilot passage 28, and blocks a flow of the working oil from the pilot chamber 51 to the second control valve 26 in the pilot passage 28.

In the fluid pressure control device 400, the pilot chamber 51 is connected to a discharge passage 6 through a discharge passage 52. A throttle 53 is provided in the discharge passage 52.

In a case where the second control valve 26 is at an operating position 26*b* or 26*c*, the working oil discharged from a pump 1 is guided to the pilot passage 28 through a supply passage 3 and the second control valve 26. Since the throttle 53 is provided in the discharge passage 52, the working oil guided to the pilot passage 28 is supplied to the pilot chamber 51, and a switching valve 50 is switched to a communication position 50*b*. After the switching valve 50 is switched to the communication position 50*b*, the working oil guided to the pilot passage 28 is discharged to a tank 2 through the discharge passage 52 and the discharge passage 6.

In a case where second control valves 36, 46 are at operating positions 36*b* or 36*c*, 46*b* or 46*c*, respectively, the working oil of pilot passages 38, 48 is also supplied to the pilot chamber 51, and the switching valve 50 is switched to the communication position 50*b*.

In a case where all the second control valves 26, 36, 46 are at neutral positions 26*a*, 36*a*, 46*a*, respectively, supply of the working oil from the supply passage 3 to the pilot chamber 51 is blocked. The working oil in the pilot chamber 51 is discharged to the tank 2 through the discharge passage 52 and the discharge passage 6. As a result, the switching valve 50 is switched to a blocking position 50*a*.

Next, operation of the fluid pressure control device 400 will be described.

Firstly, a case where at least one of the second control valves 26, 36, 46 is at the operating position 26*b*, 26*c*, 36*b*, 36*c*, 46*b*, or 46*c* will be described.

In a case where the second control valve 26 is at the operating position 26*b* or 26*c*, the second control valve 26 allows supply of the working oil from the supply passage 3 to the pilot chamber 51. Since the throttle 53 is provided in the discharge passage 52, the working oil discharged from the pump 1 is supplied to the pilot chamber 51, and the switching valve 50 is switched to the communication position 50*b*. The switching valve 50 allows a flow of the working oil in a branching passage 5. As a result, a flow of the working oil to a first relief valve 60 is allowed.

Since the working oil is guided to the first relief valve 60, the pressure in the branching passage 5 and the supply passage 3 is restricted to be a first pressure limit value or lower by the first relief valve 60. Therefore, the pressure exceeding the first pressure limit value can be prevented from acting on a tilt cylinder 20 through the second control valve 26.

In a case where the second control valves 36, 46 are at the operating positions 36*b* or 36*c*, 46*b* or 46*c*, respectively, as well as a case where the second control valve 26 is at the operating position 26*b* or 26*c*, the pressure exceeding the first pressure limit value can be prevented from acting on attached equipment actuators 30, 40.

Next, a case where all the second control valves 26, 36, 46 are at the neutral positions 26*a*, 36*a*, 46*a*, respectively, will be described.

When the second control valves 26, 36, 46 are at the neutral positions 26*a*, 36*a*, 46*a*, the second control valves 26, 36, 46 block the supply of the working oil from the supply passage 3 to the pilot chamber 51. Therefore, the working oil is not supplied to the pilot chamber 51.

Since the working oil in the pilot chamber 51 is discharged to the tank 2 through the discharge passage 52 and the discharge passage 6, the switching valve 50 is switched to the blocking position 50*a*. As a result, the flow of the working oil in the branching passage 5 is blocked, so that the flow of the working oil to the first relief valve 60 is blocked.

Since the working oil does not flow to the first relief valve 60, the pressure in the supply passage 3 is not restricted by the first pressure limit value. That is, the pressure in the supply passage 3 can be increased more than the first pressure limit value. Therefore, when a first control valve 16 is switched to a lifting position 16*b* and a lift cylinder 10 is extended, the pressure exceeding the first pressure limit value can act on the lift cylinder 10.

According to the above fourth embodiment, as well as the first embodiment, the fluid pressure control device 400 can be more downsized. In addition, the pressure exceeding the first pressure limit value can be prevented from acting on the low pressure actuators 20, 30, 40. Further, the pressure exceeding a second pressure limit value can be prevented from acting on the high pressure actuator 10.

Fifth Embodiment

Next, with reference to FIG. 7, a fluid pressure control device 500 according to a fifth embodiment of the present invention will be described. The same configurations as the configurations in the first and fourth embodiments will be given the same reference signs, and description thereof will be omitted.

Figure 7:
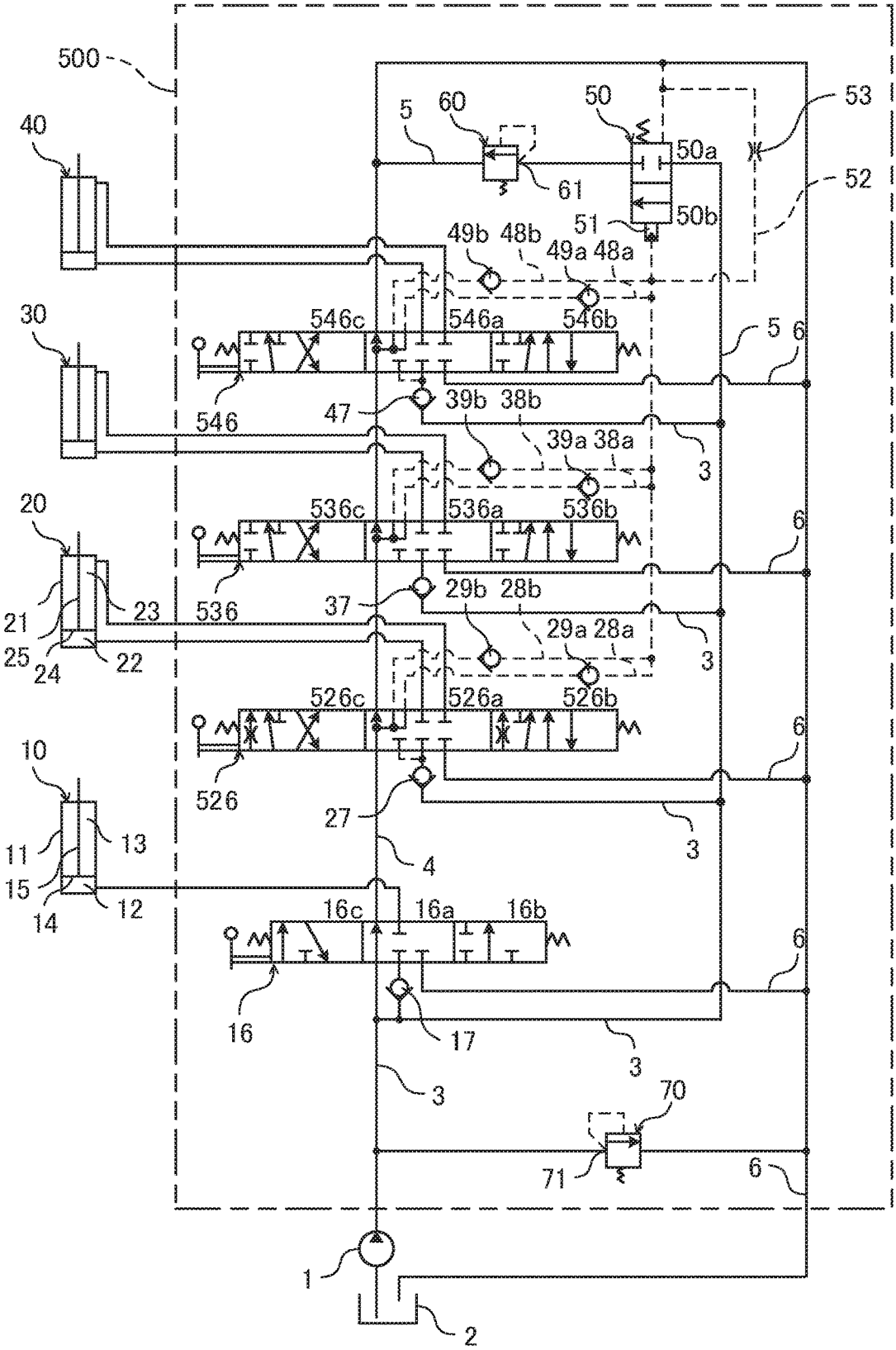
FIG. 7 is a hydraulic circuit diagram of a fluid pressure control device according to a fifth embodiment of the present invention.

As shown in FIG. 7, a second control valve 526 is a nine-port three-position switching valve. Pilot passages 28*a*, 28*b* connect a pilot chamber 51 and the second control valve 526. Check valves 29*a*, 29*b* are respectively provided in the pilot passages 28*a*, 28*b*.

The check valve 29*a* allows a flow of the working oil from the second control valve 526 to the pilot chamber 51 in the pilot passage 28*a*, and blocks a flow of the working oil from the pilot chamber 51 to the second control valve 526 in the pilot passage 28*a*. The check valve 29*b* allows a flow of the working oil from the second control valve 526 to the pilot chamber 51 in the pilot passage 28*b*, and blocks a flow of the working oil from the pilot chamber 51 to the second control valve 526 in the pilot passage 28*b*.

In a case where the second control valve 526 is at a neutral position 526*a*, the second control valve 526 separates the pilot passages 28*a*, 28*b* from a supply passage 3. That is, in a case where the second control valve 526 is at the neutral position 526*a*, the second control valve 526 blocks supply of the working oil from the supply passage 3 to the pilot chamber 51.

In a case where the second control valve 526 is at an operating position 526*b*, the second control valve 526 connects the pilot passage 28*a* to the supply passage 3 and separates the pilot passage 28*b* from the supply passage 3. That is, in a case where the second control valve 526 is at the operating position 526*b*, the second control valve 526 allows supply of the working oil from the supply passage 3 to the pilot chamber 51 through the pilot passage 28*a*. The working oil discharged from a pump 1 is supplied to the pilot chamber 51 through the supply passage 3, the second control valve 526, and the pilot passage 28*a*, and a switching valve 50 is switched to a communication position 50*b*.

In a case where the second control valve 526 is at an operating position 526*c*, the second control valve 526 connects the pilot passage 28*b* to the supply passage 3 and separates the pilot passage 28*a* from the supply passage 3. That is, in a case where the second control valve 526 is at the operating position 526*c*, the second control valve 526 allows supply of the working oil from the supply passage 3 to the pilot chamber 51 through the pilot passage 28*b*. The working oil discharged from the pump 1 is supplied to the pilot chamber 51 through the supply passage 3, the second control valve 526, and the pilot passage 28*b*, and the switching valve 50 is switched to the communication position 50*b*.

Second control valves 536, 546 are nine-port three-position switching valves as well as the second control valve 526. Pilot passages 38*a*, 38*b* connect the pilot chamber 51 and the second control valve 536, and pilot passages 48*a*, 48*b* connect the pilot chamber 51 and the second control valve 546. Check valves 39*a*, 39*b*, 49*a*, 49*b* are respectively provided in the pilot passages 38*a*, 38*b*, 48*a*, 48*b*.

In a case where the second control valve 536 is at a neutral position 536*a*, the second control valve 536 separates the pilot passages 38*a*, 38*b* from the supply passage 3. In a case where the second control valve 546 is at a neutral position 546*a*, the second control valve 536 separates the pilot passages 48*a*, 48*b* from the supply passage 3.

In a case where the second control valves 536, 546 are at operating positions 536*b*, 546*b*, respectively, the second control valves 536, 546 connect the pilot passages 38*a*, 48*a* to the supply passage 3 and separate the pilot passages 38*b*, 48*b* from the supply passage 3. The working oil discharged from the pump 1 is supplied to the pilot chamber 51 through the supply passage 3, the second control valves 536, 546, and the pilot passages 38*a*, 48*a*, and the switching valve 50 is switched to the communication position 50*b*.

In a case where the second control valves 536, 546 are at operating positions 536*c*, 546*c*, the second control valves 536, 546 connect the pilot passages 38*b*, 48*b* to the supply passage 3 and separate the pilot passages 38*a*, 48*a* from the supply passage 3. The working oil discharged from the pump 1 is supplied to the pilot chamber 51 through the supply passage 3, the second control valves 536, 546, and the pilot passages 38*b*, 48*b*, and the switching valve 50 is switched to the communication position 50*b*.

Next, operation of the fluid pressure control device 500 will be described.

Firstly, a case where at least one of the second control valves 526, 536, 546 is at the operating position 526*b*, 526*c*, 536*b*, 536*c*, 546*b*, or 546*c* will be described.

In a case where the second control valve 526 is at the operating position 526*b*, the second control valve 526 allows the supply of the working oil from the supply passage 3 to the pilot chamber 51 through the pilot passage 28*a*. In a case where the second control valve 526 is at the operating position 526*c*, the second control valve 526 allows the supply of the working oil from the supply passage 3 to the pilot chamber 51 through the pilot passage 28*b*. Since a throttle 53 is provided in a discharge passage 52, the working oil discharged from the pump 1 is supplied to the pilot chamber 51, and the switching valve 50 is switched to the communication position 50*b*. The switching valve 50 allows a flow of the working oil in a branching passage 5. As a result, a flow of the working oil to a first relief valve 60 is allowed.

Since the working oil is guided to the first relief valve 60, the pressure in the branching passage 5 and the supply passage 3 is restricted to be a first pressure limit value or lower by the first relief valve 60. Therefore, the pressure exceeding the first pressure limit value can be prevented from acting on a tilt cylinder 20 through the second control valve 526.

In a case where the second control valves 536, 546 are at the operating positions 536*b* or 536*c*, 546*b* or 546*c*, respectively, as well as a case where the second control valve 526 is at the operating position 526*b* or 526*c*, the pressure exceeding the first pressure limit value can be prevented from acting on attached equipment actuators 30, 40.

A case where all the second control valves 526, 536, 546 are at the neutral positions 526*a*, 536*a*, 546*a* is the substantially same as the fourth embodiment. Thus, description thereof will be omitted.

According to the above fifth embodiment, as well as the first embodiment, the fluid pressure control device 500 can be more downsized. In addition, the pressure exceeding the first pressure limit value can be prevented from acting on the low pressure actuators 20, 30, 40. Further, the pressure exceeding a second pressure limit value can be prevented from acting on the high pressure actuator 10.

Sixth Embodiment

Next, with reference to FIG. 8, a fluid pressure control device 600 according to a sixth embodiment of the present invention will be described. The same configurations as the configurations in the first and fourth embodiments will be given the same reference signs, and description thereof will be omitted.

Figure 8:
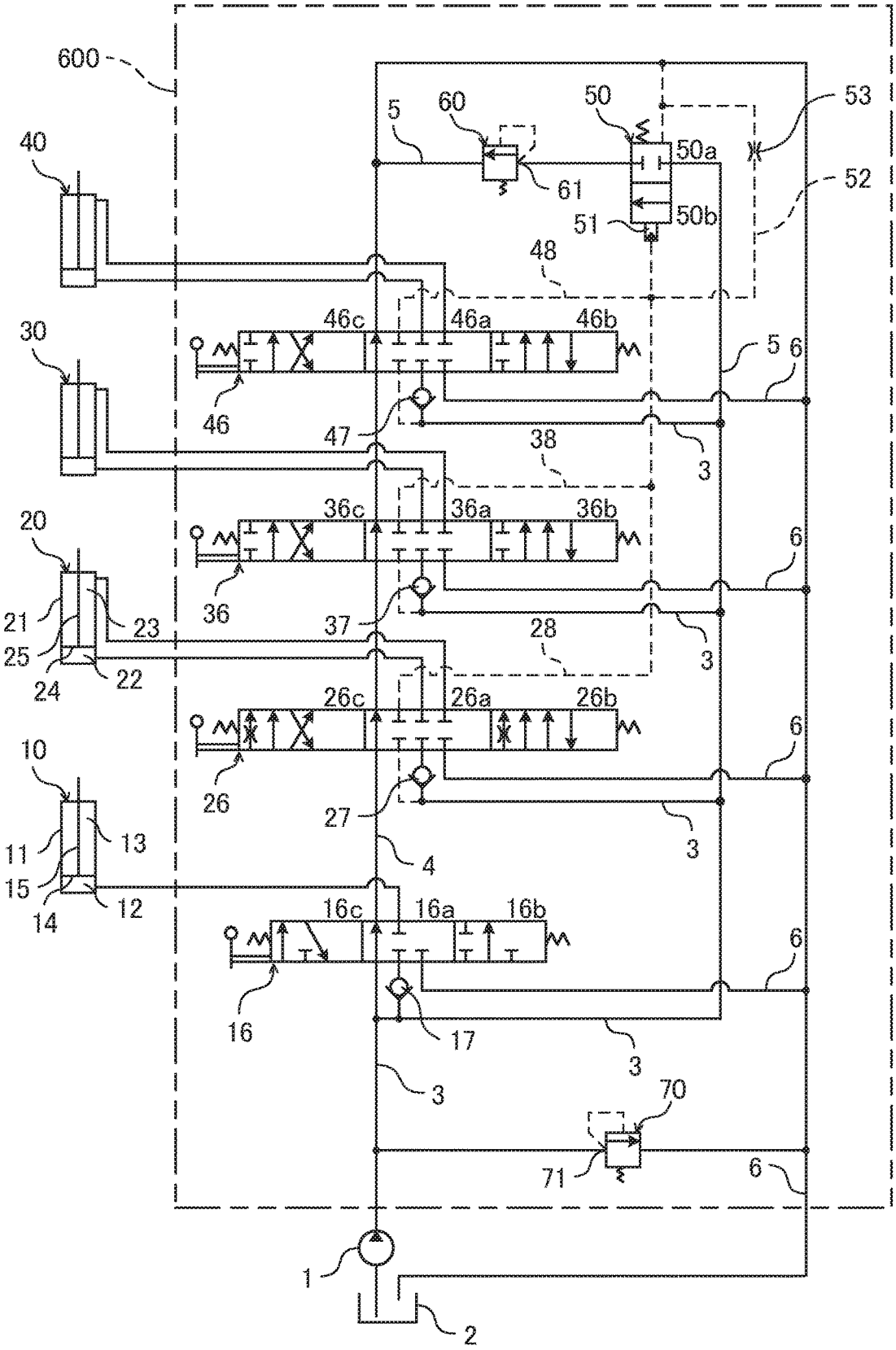
FIG. 8 is a hydraulic circuit diagram of a fluid pressure control device according to a sixth embodiment of the present invention.

As shown in FIG. 8, pilot passages 38, 48 are not connected to a bypass passage 4 through second control valves 36, 46 but connected to a discharge passage 6 only through a discharge passage 52 having a throttle 53. Therefore, in a case where a second control valve 26 is at an operating position 26*b* or 26*c*, and even when no check valves 39, 49 (see FIG. 6) are provided in the pilot passages 38, 48, the working oil discharged from a pump 1 is supplied to a pilot chamber 51 through a pilot passage 28.

The pilot passage 28 is not connected to the bypass passage 4 through the second control valve 26 but connected to the discharge passage 6 only through the discharge passage 52 having the throttle 53. Therefore, in a case where the second control valves 36, 46 are at operating positions 36*b* or 36*c*, 46*b* or 46*c*, respectively, and even when no check valve 29 (see FIG. 6) is provided in the pilot passage 28, the working oil discharged from the pump 1 is supplied to the pilot chamber 51 through the pilot passages 38, 48.

In a case where all the second control valves 26, 36, 46 are at neutral positions 26*a*, 36*a*, 46*a*, supply of the working oil from the supply passage 3 to the pilot chamber 51 is blocked. The working oil in the pilot chamber 51 is discharged to a tank 2 through the discharge passage 52 and the discharge passage 6. As a result, a switching valve 50 is switched to a blocking position 50*a*.

Operation of the fluid pressure control device 600 are the substantially same as those of the fluid pressure control device 400 according to the fourth embodiment (see FIG. 6). Thus, description thereof will be omitted.

According to the above sixth embodiment, as well as the first embodiment, the fluid pressure control device 600 can be more downsized. In addition, the pressure exceeding a first pressure limit value can be prevented from acting on low pressure actuators 20, 30, 40. Further, the pressure exceeding a second pressure limit value can be prevented from acting on a high pressure actuator 10.

Seventh Embodiment

Next, with reference to FIG. 9, a fluid pressure control device 700 according to a seventh embodiment of the present invention will be described. The same configurations as the configurations in the first and fifth embodiments will be given the same reference signs, and description thereof will be omitted.

Figure 9:
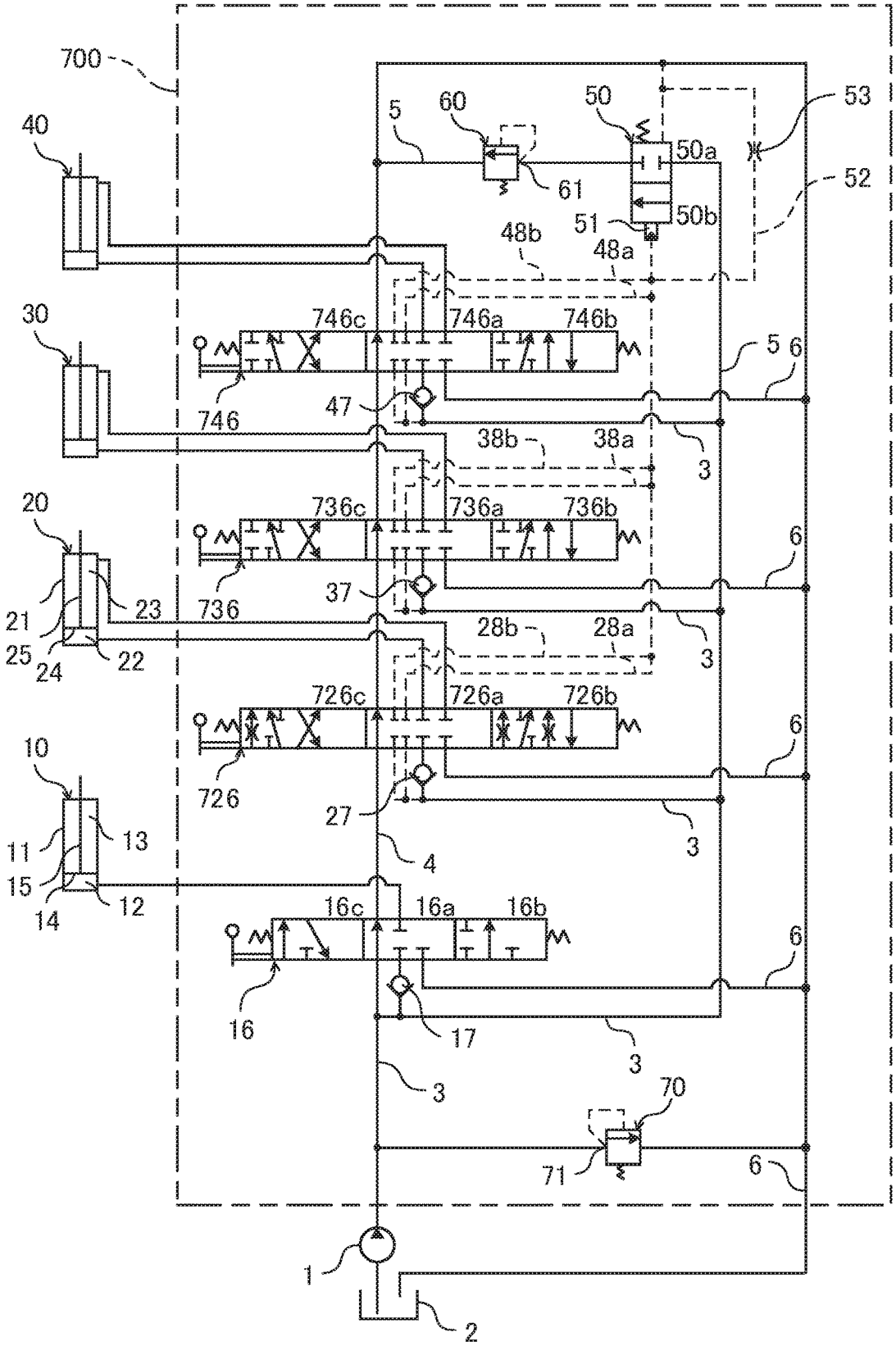
FIG. 9 is a hydraulic circuit diagram of a fluid pressure control device according to a seventh embodiment of the present invention.

As shown in FIG. 9, a second control valve 726 is a ten-port three-position switching valve. Pilot passages 28*a*, 28*b* connect a pilot chamber 51 and the second control valve 726. Second control valves 736, 746 are ten-port three-position switching valves as well as the second control valve 726. Pilot passages 38*a*, 38*b* connect the pilot chamber 51 and the second control valve 736, and pilot passages 48*a*, 48*b* connect the pilot chamber 51 and the second control valve 746.

Pilot passages 38*a*, 38*b*, 48*a*, 48*b* are not connected to a bypass passage 4 through second control valves 736, 746 but connected to a discharge passage 6 only through a discharge passage 52 having a throttle 53. Therefore, in a case where the second control valve 726 is at an operating position 726*b* or 726*c*, and even when no check valves 39*a*, 39*b*, 49*a*, 49*b* (see FIG. 7) are provided in the pilot passages 38*a*, 38*b*, 48*a*, 48*b*, respectively, the working oil discharged from a pump 1 is supplied to the pilot chamber 51.

The pilot passages 28*a*, 28*b* are not connected to the bypass passage 4 through the second control valve 726 but connected to the discharge passage 6 only through the discharge passage 52 having the throttle 53. Therefore, in a case where the second control valves 736, 746 are at operating positions 736*b* or 736*c*, 746*b* or 746*c*, respectively, and even when no check valves 29*a*, 29*b* (see FIG. 7) are provided in the pilot passages 28*a*, 28*b*, respectively, the working oil discharged from the pump 1 is supplied to the pilot chamber 51.

In a case where all the second control valves 726, 736, 746 are at neutral positions 726*a*, 736*a*, 746*a*, supply of the working oil from a supply passage 3 to the pilot chamber 51 is blocked. The working oil in the pilot chamber 51 is discharged to a tank 2 through the discharge passage 52 and the discharge passage 6. As a result, a switching valve 50 is switched to a blocking position 50*a*.

Operation of the fluid pressure control device 700 are the substantially same as those of the fluid pressure control device 500 according to the fifth embodiment. Thus, description thereof will be omitted.

According to the above seventh embodiment, as well as the first embodiment, the fluid pressure control device 700 can be more downsized. In addition, the pressure exceeding a first pressure limit value can be prevented from acting on low pressure actuators 20, 30, 40. Further, the pressure exceeding a second pressure limit value can be prevented from acting on a high pressure actuator 10.

Eighth Embodiment

Next, with reference to FIGS. 10 and 11, a fluid pressure control device 800 according to an eighth embodiment of the present invention will be described. The same configurations as the configurations in the first embodiment will be given the same reference signs, and description thereof will be omitted.

Figure 10:
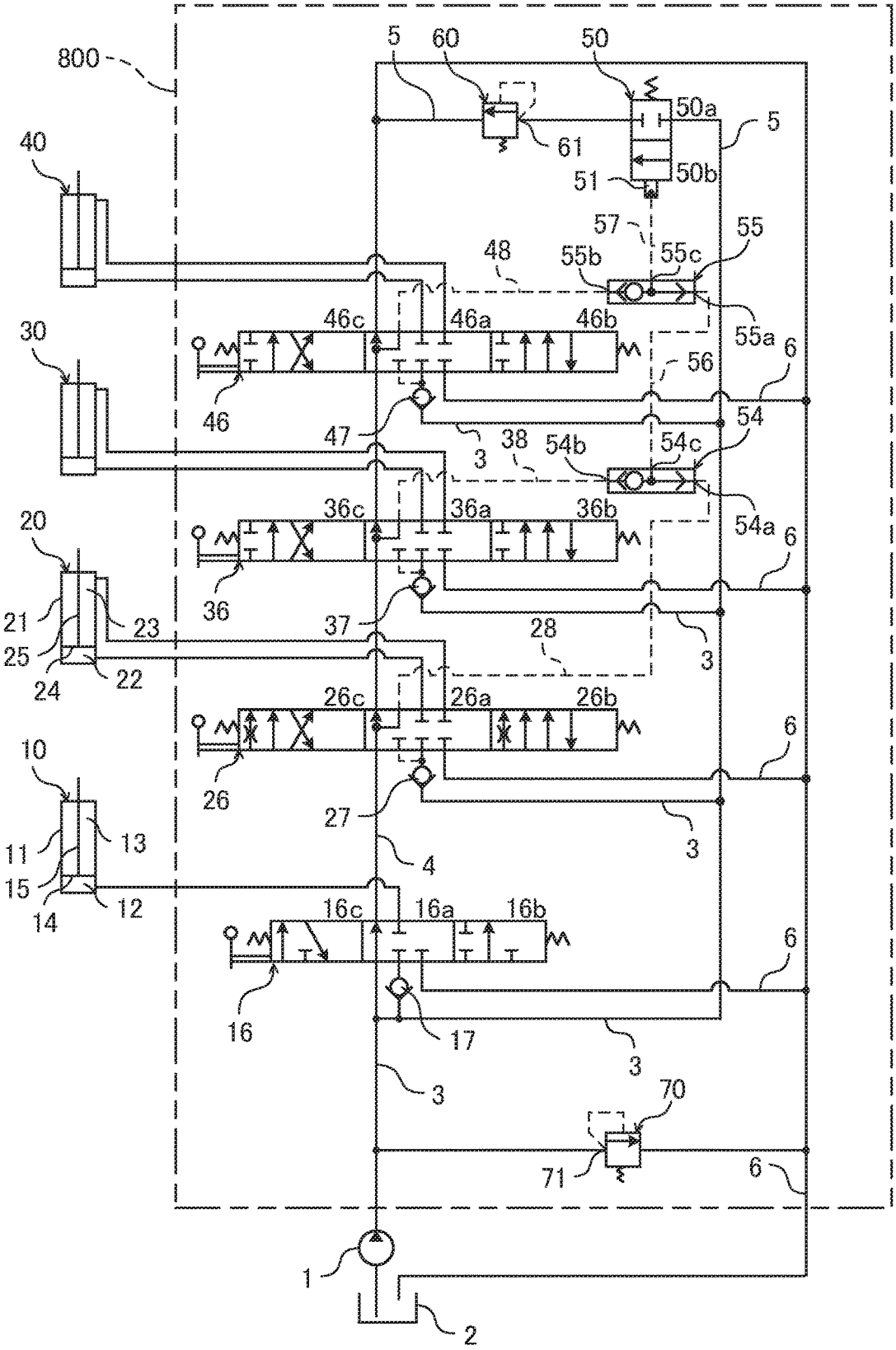
FIG. 10 is a hydraulic circuit diagram of a fluid pressure control device according to an eighth embodiment of the present invention.

As shown in FIG. 10, the fluid pressure control device 800 includes shuttle valves 54, 55 serving as higher pressure selection valves. The shuttle valve 54 has first, second, and third ports 54*a*, 54*b*, 54*c*, and the shuttle valve 55 has first, second, and third ports 55*a*, 55*b*, 55*c*.

The first port 54*a* of the shuttle valve 54 is connected to a second control valve 26 through a pilot passage 28, and the second port 54*b* is connected to a second control valve 36 through a pilot passage 38. The third port 54*c* of the shuttle valve 54 is connected to the first port 55*a* of the shuttle valve 55 through a pilot passage 56. The second port 55*b* of the shuttle valve 55 is connected to a second control valve 46 through a pilot passage 48, and the third port 55*c* is connected to a pilot chamber 51 through a pilot passage 57.

Hereinafter, the pilot passages 28, 56 will sometimes be referred to as the "first pilot passages", and the pilot passages 38, 48 will sometimes be referred to as the "second pilot passages".

Figure 11:
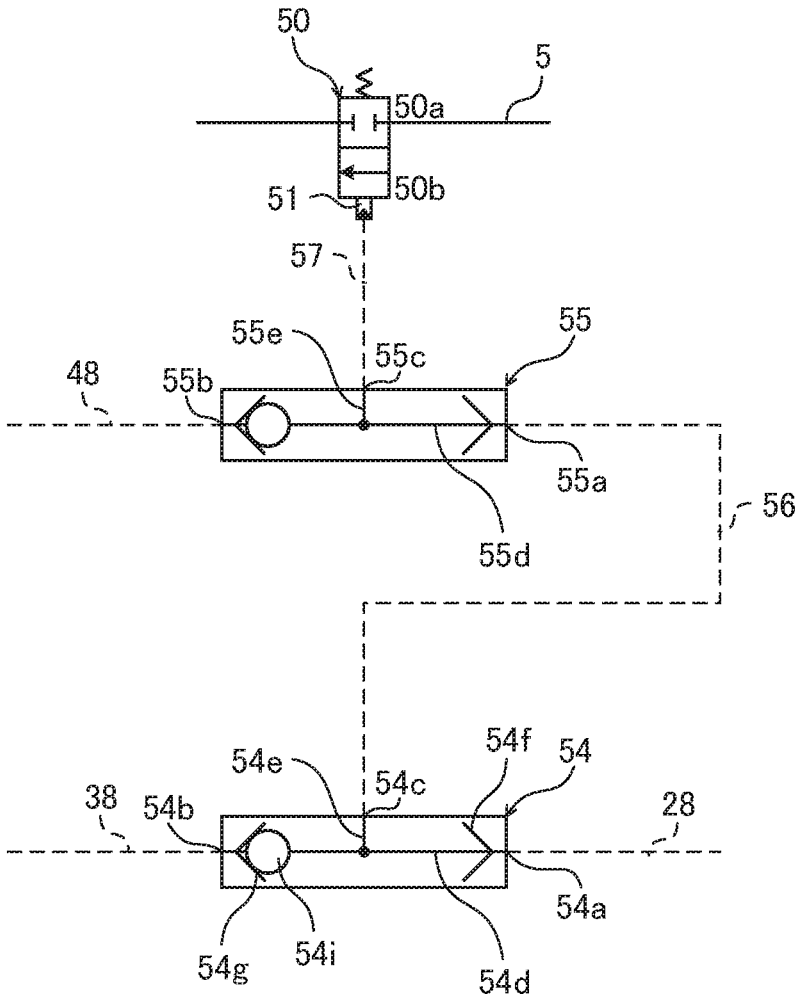
FIG. 11 is a hydraulic circuit diagram showing a periphery of a switching valve 50 and shuttle valves 54, 55 in FIG. 10.

FIG. 11 is a hydraulic circuit diagram showing a periphery of a switching valve 50 and the shuttle valves 54, 55. As shown in FIG. 11, the shuttle valve 54 has a passage 54*d* communicating with the first port 54*a* and the second port 54*b*, and a passage 54*e* branching from the passage 54*d* and communicating with the third port 54*c*. A first seat portion 54*f* is formed in one end part (end part on the side of the first port 54*a*) of the passage 54*d*, and a second seat portion 54*g* is formed in the other end part (end part on the side of the second port 54*b*) of the passage 54*d*. A valve body 54*i* is movably provided in the passage 54*d*.

When pressure in the pilot passage (first pilot passage) 28 is higher than pressure in the pilot passage (second pilot passage) 38, the valve body 54*i* is taken away from the first seat portion 54*f* and seated on the second seat portion 54*g*. As a result, communication between the pilot passage (second pilot passage) 38 and the pilot passage 56 is blocked, and communication between the pilot passage (first pilot passage) 28 and the pilot passage 56 is allowed.

When the pressure in the pilot passage (first pilot passage) 28 is lower than the pressure in the pilot passage (second pilot passage) 38, the valve body 54*i* is taken away from the second seat portion 54*g* and seated on the first seat portion 54*f*. As a result, the communication between the pilot passage (first pilot passage) 28 and the pilot passage 56 is blocked, and the communication between the pilot passage (second pilot passage) 38 and the pilot passage 56 is allowed.

In such a way, the shuttle valve 54 allows the communication between one of the pilot passages 28, 38 and the pilot passage 56 and blocks the communication between the other pilot passage 28 or 38 and the pilot passage 56 in accordance with a difference between the pressure in the pilot passage (first pilot passage) 28 and the pressure in the pilot passage (second pilot passage) 38.

As well as the shuttle valve 54, the shuttle valve 55 provides communication between one of the pilot passages 56, 48 and the pilot passage 57 and blocks communication between the other pilot passage 56 or 48 and the pilot passage 57 in accordance with a difference between pressure in the pilot passage (first pilot passage) 56 and pressure in the pilot passage (second pilot passage) 48. Since a structure of the shuttle valve 55 is the same as a structure of the shuttle valve 54, description thereof will be omitted.

Next, with reference to FIGS. 10 and 11, operation of the fluid pressure control device 800 will be described.

Firstly, a case where the second control valve 26 is at an operating position 26*b* or 26*c*, and the second control valves 36, 46 are at neutral positions 36*a*, 46*a* will be described.

In a case where the second control valve 26 is at the operating position 26*b* or 26*c*, the second control valve 26 allows a flow from a supply passage 3 to the pilot passage 28, and blocks communication between a bypass passage 4 and the pilot passage 28 through the second control valve 26. The pilot passage 28 communicates with a pump 1 through the second control valve 26 and the supply passage 3, and discharge pressure of the pump 1 acts on the pilot passage (first pilot passage) 28.

A first control valve 16 and the second control valve 26 are provided in the bypass passage 4 on the upstream side of the second control valves 36, 46. Therefore, in a case where the second control valves 36, 46 are at the neutral positions 36*a*, 46*a*, the pilot passage 38 communicates with a tank 2 through the second control valves 36, 46, the bypass passage 4, and a discharge passage 6 irrespective of positions of the first control valve 16 and the second control valve 26. Thus, the pressure in the pilot passage (second pilot passage) 38 is lower than the pressure in the pilot passage (first pilot passage) 28, and the valve body 54*i* of the shuttle valve 54 is seated on the second seat portion 54*g*. As a result, the pilot passage (first pilot passage) 28 and the pilot passage 56 communicate with each other through the shuttle valve 54, and the discharge pressure of the pump 1 acts on the pilot passage 56.

In a case where the second control valve 46 is at a neutral position 46*a*, the pilot passage 48 communicates with the tank 2 through the second control valve 46, the bypass passage 4, and the discharge passage 6. Therefore, the pressure in the pilot passage (second pilot passage) 48 is lower than the pressure in the pilot passage (first pilot passage) 56, and the valve body 55*i* of the shuttle valve 55 is seated on the second seat portion 55*g*. As a result, the pilot passage 57 communicates with the pump 1 through the pilot passages 56, 28, the second control valve 26, and the supply passage 3, and the working oil discharged from the pump 1 is supplied to the pilot chamber 51.

By supplying the working oil to the pilot chamber 51, the switching valve 50 is switched to a communication position 50*b*. The switching valve 50 allows a flow of the working oil in a branching passage 5. As a result, a flow of the working oil to a first relief valve 60 is allowed.

Since the branching passage 5 communicates with the supply passage 3, the first relief valve 60 restricts the pressure in the branching passage 5 and the supply passage 3 to a first pressure limit value or lower. Therefore, even when a tilt cylinder 20 communicates with the supply passage 3, the pressure exceeding the first pressure limit value can be prevented from acting on the tilt cylinder 20.

By setting the first pressure limit value to a pressure upper limit value of the tilt cylinder 20 or lower, the pressure exceeding the pressure upper limit value of the tilt cylinder 20 does not act on the tilt cylinder 20. As a result, damage to the tilt cylinder 20 can be prevented.

Next, a case where the second control valve 36 is at an operating position 36*b* or 36*c* and the second control valves 26, 46 are at the neutral positions 26*a*, 46*a* will be described.

In a case where the second control valve 36 is at the operating position 36*b* or 36*c*, the second control valve 36 allows a flow from the supply passage 3 to the pilot passage 38, blocks communication between the bypass passage 4 and the pilot passage 38 through the second control valve 36, and blocks a flow of the working oil in the bypass passage 4. The pilot passage 38 communicates with the pump 1 through the second control valve 36 and the supply passage 3, and the discharge pressure of the pump 1 acts on the pilot passage (second pilot passage) 38.

Since the second control valve 26 is at the neutral position 26*a*, the pilot passage (first pilot passage) 28 communicates with the bypass passage 4 through the second control valve 26.

Dividing into a case where the first control valve 16 is at a neutral position 16*a* or a lowering position 16*c*, and a case where the first control valve 16 is at a lifting position 16*b*, the pressure acting on the pilot passage 56 will be described.

In a case where the first control valve 16 is at the neutral position 16*a* or the lowering position 16*c*, the pilot passage 28 communicates with the pump 1 through the second control valve 26, the bypass passage 4, and the first control valve 16. Therefore, the discharge pressure of the pump 1 acts on the pilot passage (first pilot passage) 28.

Since the discharge pressure of the pump 1 acts on both the pilot passages 28, 38, the valve body 54*i* of the shuttle valve 54 is not moved. Therefore, when the valve body 54*i* is seated on the first seat portion 54*f*, the pilot passage (second pilot passage) 38 and the pilot passage 56 communicate with each other, and the discharge pressure of the pump 1 acts on the pilot passage 56. When the valve body 54*i* is seated on the second seat portion 54*g*, the pilot passage (first pilot passage) 28 and the pilot passage 56 communicate with each other, and the discharge pressure of the pump 1 acts on the pilot passage 56. That is, irrespective of the position of the valve body 54*i*, the discharge pressure of the pump 1 acts on the pilot passage 56.

In a case where the first control valve 16 is at the lifting position 16*b*, the flow of the working oil in the bypass passage 4 is blocked on the upstream side of the second control valve 26, and the discharge pressure of the pump 1 does not act on the pilot passage (first pilot passage) 28. Therefore, the pressure in the pilot passage (first pilot passage) 28 is lower than the pressure in the pilot passage (second pilot passage) 38, and the valve body 54*i* of the shuttle valve 54 is seated on the first seat portion 54*f*. Therefore, the pilot passage (second pilot passage) 38 and the pilot passage 56 communicate with each other through the shuttle valve 54, and the discharge pressure of the pump 1 acts on the pilot passage 56.

In such a way, irrespective of the position of the first control valve 16, the discharge pressure of the pump 1 acts on the pilot passage 56.

In a case where the second control valve 46 is at the neutral position 46*a*, the pilot passage 48 communicates with the tank 2 through the second control valve 46, the bypass passage 4, and the discharge passage 6. Therefore, the pressure in the pilot passage (second pilot passage) 48 is lower than the pressure in the pilot passage (first pilot passage) 56, and the valve body 55*i* of the shuttle valve 55 is seated on the second seat portion 55*g*. As a result, the pilot passage 57 communicates with the pump 1 through the pilot passage (first pilot passage) 56, and the working oil discharged from the pump 1 is supplied to the pilot chamber 51.

By supplying the working oil to the pilot chamber 51, as well as a case where the second control valve 26 is at the operating position 26*b* or 26*c*, the pressure exceeding the first pressure limit value can be prevented from acting on an attached equipment actuator 30.

Next, a case where the second control valve 46 is at an operating position 46*b* or 46*c* and the second control valves 26, 36 are at the neutral positions 26*a*, 36*a*, respectively, will be described.

In a case where the second control valve 46 is at the operating position 46*b* or 46*c*, the second control valve 46 allows a flow from the supply passage 3 to the pilot passage 48, blocks communication between the bypass passage 4 and the pilot passage 48 through the second control valve 46, and blocks the flow of the working oil in the bypass passage 4. The pilot passage 48 communicates with the pump 1 through the second control valve 46 and the supply passage 3, and the discharge pressure of the pump 1 acts on the pilot passage (second pilot passage) 48.

Since the second control valve 26 is at the neutral position 26*a*, the pilot passage 28 communicates with the bypass passage 4 through the second control valve 26. Since the second control valve 36 is at the neutral position 36*a*, the pilot passage 38 communicates with the bypass passage 4 through the second control valve 36.

Dividing into a case where the first control valve 16 is at the neutral position 16*a* or the lowering position 16*c*, and a case where the first control valve 16 is at the lifting position 16*b*, supply of the working oil to the pilot passage 57 will be described.

In a case where the first control valve 16 is at the neutral position 16*a* or the lowering position 16*c*, the pilot passage (first pilot passage) 28 communicates with the pump 1 through the second control valve 26, the bypass passage 4, and the first control valve 16. The pilot passage (second pilot passage) 38 communicates with the pump 1 through the second control valve 36, the bypass passage 4, the second control valve 26, and the first control valve 16. Therefore, the discharge pressure of the pump 1 acts on both the pilot passages 28, 38.

Since the discharge pressure of the pump 1 acts on both the pilot passages 28, 38, irrespective of the position of the valve body 54*i* of the shuttle valve 54, the discharge pressure of the pump 1 acts on the pilot passage (first pilot passage) 56. Since the discharge pressure of the pump 1 acts on the pilot passage (second pilot passage) 48 through the second control valve 46 and the supply passage 3, the pilot passage 57 communicates with the pump 1 through the shuttle valve 55 irrespective of the position of the valve body 55*i* of the shuttle valve 55. Therefore, the working oil discharged from the pump 1 is supplied to the pilot chamber 51 through the supply passage 3, the second control valve 46, the pilot passage 48, and the pilot passage 57, or through the bypass passage 4, the second control valves 26, 36, the pilot passage 56, and the pilot passage 57.

In a case where the first control valve 16 is at the lifting position 16*b*, the flow of the working oil in the bypass passage 4 is blocked on the upstream side of the second control valves 26, 36, and the discharge pressure of the pump 1 does not act on the pilot passages 28, 38. Therefore, the pressure in the pilot passage (first pilot passage) 56 is lower than the pressure in the pilot passage (second pilot passage) 48, and the valve body 55*i* of the shuttle valve 55 is seated on a first seat portion 55*f*. As a result, the pilot passage (second pilot passage) 48 and the pilot passage 57 communicate with each other through the shuttle valve 55. The working oil discharged from the pump 1 is supplied to the pilot chamber 51 through the supply passage 3, the second control valve 46, the pilot passage 48, and the pilot passage 57.

In such a way, irrespective of the position of the first control valve 16, the working oil is supplied to the pilot chamber 51.

By supplying the working oil to the pilot chamber 51, as well as a case where the second control valve 26 is at the operating position 26*b* or 26*c*, the pressure exceeding the first pressure limit value can be prevented from acting on an attached equipment actuator 40.

In a case where any two of the second control valves 26, 36, 46 are at the operating positions and the remaining one is at the neutral position, and in a case where all the second control valves 26, 36, 46 are at the operating positions, the working oil is also supplied to the pilot chamber 51 irrespective of the position of the first control valve 16. Therefore, the pressure exceeding the first pressure limit value can be prevented from acting on the low pressure actuators 20, 30, 40.

Next, a case where all the second control valves 26, 36, 46 are at the neutral positions 26*a*, 36*a*, 46*a* will be described.

In a case where the second control valve 26 is at the neutral position 26*a*, the second control valve 26 blocks the flow of the working oil from the supply passage 3 to the pilot passage 28, allows the flow of the working oil in the bypass passage 4, and allows the communication between the pilot passage 28 and the bypass passage 4 through the second control valve 26. In a case where the second control valve 36 is at the neutral position 36*a*, the second control valve 36 blocks the flow of the working oil from the supply passage 3 to the pilot passage 38, allows the flow of the working oil in the bypass passage 4, and allows the communication between the pilot passage 38 and the bypass passage 4 through the second control valve 36. In a case where the second control valve 46 is at the neutral position 46*a*, the second control valve 46 blocks the flow of the working oil from the supply passage 3 to the pilot passage 48, allows the flow of the working oil in the bypass passage 4, and allows the communication between the pilot passage 48 and the bypass passage 4 through the second control valve 46.

Since the second control valves 26, 36, 46 allow the flow of the working oil in the bypass passage 4, the pilot passages 28, 38, 48 communicate with the tank 2 through the bypass passage 4 and the discharge passage 6. Therefore, supply of the working oil to the pilot chamber 51 is blocked, and the working oil in the pilot chamber 51 is discharged to the tank 2 through the pilot passages 57, 48, through the pilot passages 57, 56, 38, or through the pilot passages 57, 56, 28.

By discharging the working oil in the pilot chamber 51, the switching valve 50 is switched to a blocking position 50*a*. At the blocking position 50*a*, a flow of the working oil in the branching passage 5 is blocked. As a result, the flow of the working oil to the first relief valve 60 is blocked.

Since the working oil does not flow to the first relief valve 60, the pressure in the supply passage 3 is not restricted by the first pressure limit value. That is, the pressure of the supply passage 3 can be increased more than the first pressure limit value. Therefore, when the first control valve 16 is switched to the lifting position 16*b* and a lift cylinder 10 is extended, the pressure exceeding the first pressure limit value can act on the lift cylinder 10.

A flow of the working oil from the supply passage 3 to a second relief valve 70 is not blocked irrespective of the positions of the first and second control valves 16, 26, 36, 46. Therefore, the pressure in the supply passage 3 is restricted to be a second pressure limit value or lower. Even when the lift cylinder 10 communicates with the supply passage 3, the pressure exceeding the second pressure limit value can be prevented from acting on the lift cylinder 10.

In such a way, in the present embodiment, the second relief valve 70 is provided on the upstream side of the switching valve 50. Thus, the pressure in the supply passage 3 is restricted to be the second pressure limit value or lower by the second relief valve 70. Therefore, even in a case where the first relief valve 60 does not restrict the pressure in the supply passage 3, the pressure of the second pressure limit value or higher can be prevented from acting on the lift cylinder 10.

By setting the second pressure limit value to a pressure upper limit value of the lift cylinder 10 or lower, the pressure exceeding the pressure upper limit value of the lift cylinder 10 does not act on the lift cylinder 10. As a result, damage to the lift cylinder 10 can be prevented.

In the example shown in FIG. 10, the second relief valve 70 is provided on the upstream side of the switching valve 50. However, as in the second embodiment (see FIG. 4), the second relief valve 70 may be provided in the branching passage 5 on the downstream side of the switching valve 50. In this case, the switching valve 50 is a three-port two-position switching valve having a first communication position 50*a* at which the working oil in the branching passage 5 is guided to the first relief valve 60, and a second communication position 50*b* at which the flow of the working oil in the branching passage 5 is guided to the second relief valve 70.

In addition, as in the third embodiment (see FIG. 5), an unloading valve 80 may be provided in the branching passage 5 on the upstream side of the switching valve 50.

According to the above eighth embodiment, in addition to the effects obtained in the first embodiment, the following effects are obtained.

In the present embodiment, the shuttle valves 54, 55 are used in place of the check valves 39, 49 (see FIG. 1). The higher pressure selection valves such as the shuttle valves 54, 55 can be downsized more easily than the check valves 39, 49. Thus, the fluid pressure control device 800 can be more downsized.

Ninth Embodiment

Next, with reference to FIG. 12, a fluid pressure control device 900 according to a ninth embodiment of the present invention will be described. The same configurations as the configurations in the first and eight embodiments will be given the same reference signs, and description thereof will be omitted.

In the fluid pressure control devices 100, 200, 300, 400, 500, 600, 700, 800, mechanical switching valves are used as the first control valve 16 and the second control valves 26, 36, 46, 526, 536, 546, 726, 736, 746 (see FIGS. 1 to 10). In the fluid pressure control device 900, as shown in FIG. 9, electromagnetic proportional switching valves are used as a first control valve 916 and second control valves 926, 936, 946. Hereinafter, structures of the first control valve 916 and the second control valves 926, 936, 946 will be more specifically described.

The first control valve 916 has pilot chambers 916*d*, 916*e*, a solenoid 916*f* that controls supply of the working oil to the pilot chamber 916*d*, and a solenoid 916*g* that controls supply of the working oil to the pilot chamber 916*e*. In accordance with the supply of the working oil to the pilot chambers 916*d*, 916*e*, a position of the first control valve 916 is switched.

The pilot chamber 916*d* is connected to a supply passage 3 through a pilot passage 7*a*, and connected to a bypass passage 4 on the downstream side of the second control valve 946 through a discharge passage 8*a*. The pilot chamber 916*e* is connected to the supply passage 3 through a pilot passage 7*b*, and connected to the bypass passage 4 on the downstream side of the second control valve 946 through a discharge passage 8*b*.

When a controller (not shown) outputs an electric signal to the solenoid 916*f*, the solenoid 916*f* is energized, and the working oil discharged from a pump 1 is supplied to the pilot chamber 916*d* through the pilot passage 7*a*. As a result, the first control valve 916 is switched to a lifting position 916*b*.

When the controller stops output of the electric signal to the solenoid 916*f*, the solenoid 916*f* is not energized, and the supply of the working oil to the pilot chamber 916*d* is blocked. The working oil in the pilot chamber 916*d* is discharged to a tank 2 through the discharge passage 8*a*, the bypass passage 4, and a discharge passage 6. As a result, the first control valve 916 is switched to a neutral position 916*a*.

When the controller outputs an electric signal to the solenoid 916*g*, the solenoid 916*g* is energized, and the working oil discharged from the pump 1 is supplied to the pilot chamber 916*e* through the pilot passage 7*b*. As a result, the first control valve 916 is switched to a lowering position 916*c*.

When the controller stops output of the electric signal to the solenoid 916*g*, the solenoid 916*g* is not energized, and the supply of the working oil to the pilot chamber 916*e* is blocked. The working oil in the pilot chamber 916*e* is discharged to the tank 2 through the discharge passage 8*b*, the bypass passage 4, and the discharge passage 6. As a result, the first control valve 916 is switched to the neutral position 916*a*.

In such a way, the position of the first control valve 916 is switched in accordance with the output and the stop of the electric signal to the solenoids 916*f*, 916*g*.

The second control valve 926 has pilot chambers 926*d*, 926*e* and solenoids 926*f*, 926*g*. The pilot chamber 926*d* is connected to the supply passage 3 through the pilot passage 7*a*, and connected to the bypass passage 4 on the downstream side of the second control valve 946 through the discharge passage 8*a*. The pilot chamber 926*e* is connected to the supply passage 3 through the pilot passage 7*b*, and connected to the bypass passage 4 on the downstream side of the second control valve 946 through the discharge passage 8*b*.

The second control valve 936 has pilot chambers 936*d*, 936*e* and solenoids 936*f*, 936*g*. The pilot chamber 936*d* is connected to the supply passage 3 through the pilot passage 7*a*, and connected to the bypass passage 4 on the downstream side of the second control valve 946 through the discharge passage 8*a*. The pilot chamber 936*e* is connected to the supply passage 3 through the pilot passage 7*b*, and connected to the bypass passage 4 on the downstream side of the second control valve 946 through the discharge passage 8*b*.

The second control valve 946 has pilot chambers 946*d*, 946*e* and solenoids 946*f*, 946*g*. The pilot chamber 946*d* is connected to the supply passage 3 through the pilot passage 7*a*, and connected to the bypass passage 4 on the downstream side of the second control valve 946 through the discharge passage 8*a*. The pilot chamber 946*e* is connected to the supply passage 3 through the pilot passage 7*b*, and connected to the bypass passage 4 on the downstream side of the second control valve 946 through the discharge passage 8*b*.

Actions of the second control valves 926, 936, 946 are the substantially same as action of the first control valve 916. Thus, description thereof will be omitted.

Operation of the fluid pressure control device 900 are the substantially same as the operation of the fluid pressure control device 800 (see FIG. 10). Thus, description thereof will be omitted.

Figure 12:
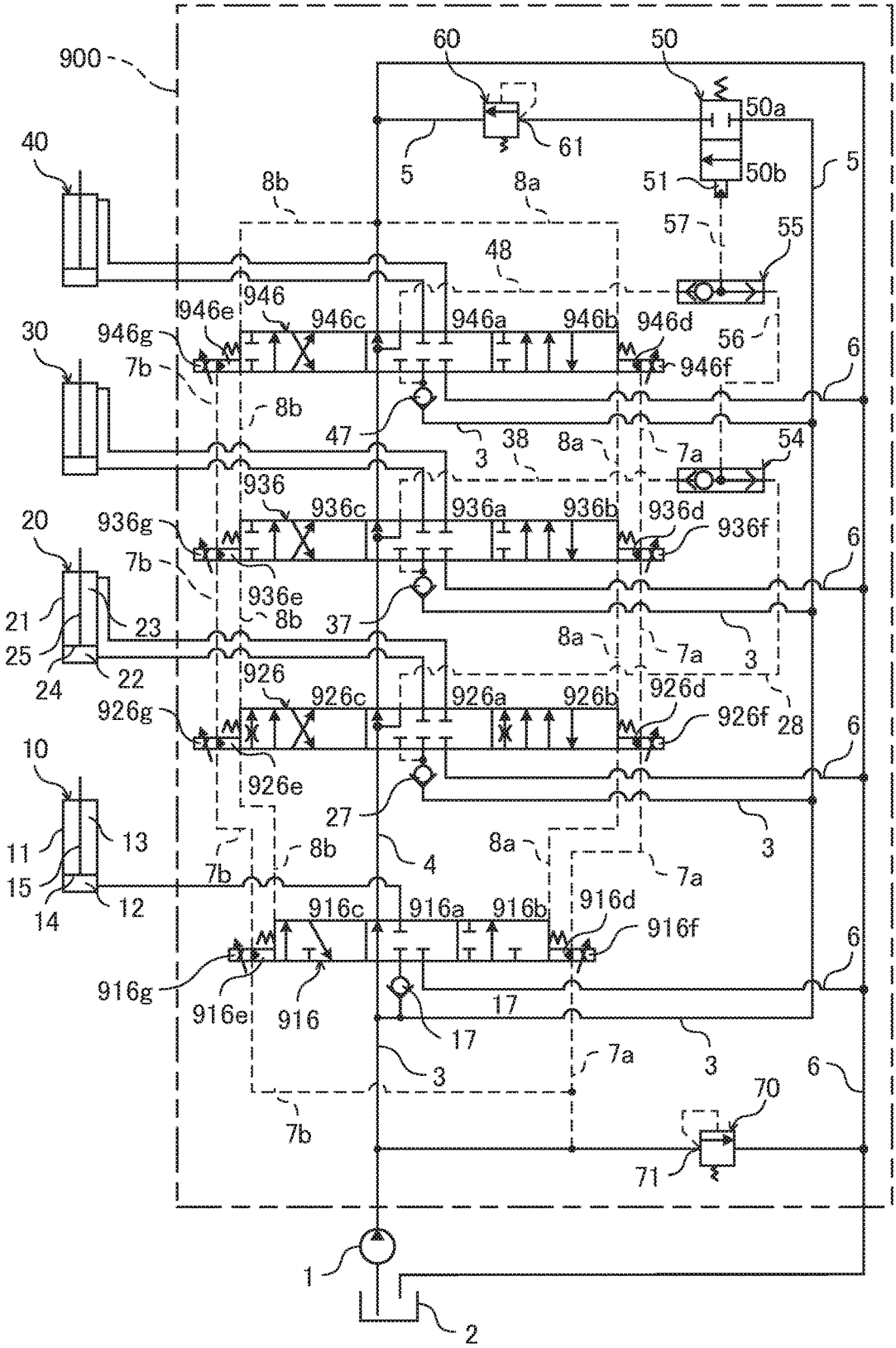
FIG. 12 is a hydraulic circuit diagram of a fluid pressure control device according to a ninth embodiment of the present invention.

In the example shown in FIG. 12, a second relief valve 70 is provided on the upstream side of a switching valve 50. However, as in the second embodiment (see FIG. 4), the second relief valve 70 may be provided in a branching passage 5 on the downstream side of a switching valve 250. In this case, the switching valve 250 is a three-port two-position switching valve having a first communication position 250*a* at which the working oil in the branching passage 5 is guided to a first relief valve 60, and a second communication position 250*b* at which a flow of the working oil in the branching passage 5 is guided to the second relief valve 70 (see FIG. 4).

In addition, as in the third embodiment (see FIG. 5), an unloading valve 80 may be provided in the branching passage 5 on the upstream side of the switching valve 50.

Electromagnetic proportional switching valves may be used as the first and second control valves 16, 26, 36, 46, 526, 536, 546, 726, 736, 746 in the first to seventh embodiments (see FIGS. 1 to 9) as in the present embodiment.

According to the above ninth embodiment, as well as the eighth embodiment, the fluid pressure control device 900 can be more downsized.

Tenth Embodiment

Next, with reference to FIG. 13, a fluid pressure control device 1000 according to a tenth embodiment of the present invention will be described. The same configurations as the configurations in the first to eighth embodiments will be given the same reference signs, and description thereof will be omitted.

Figure 13:
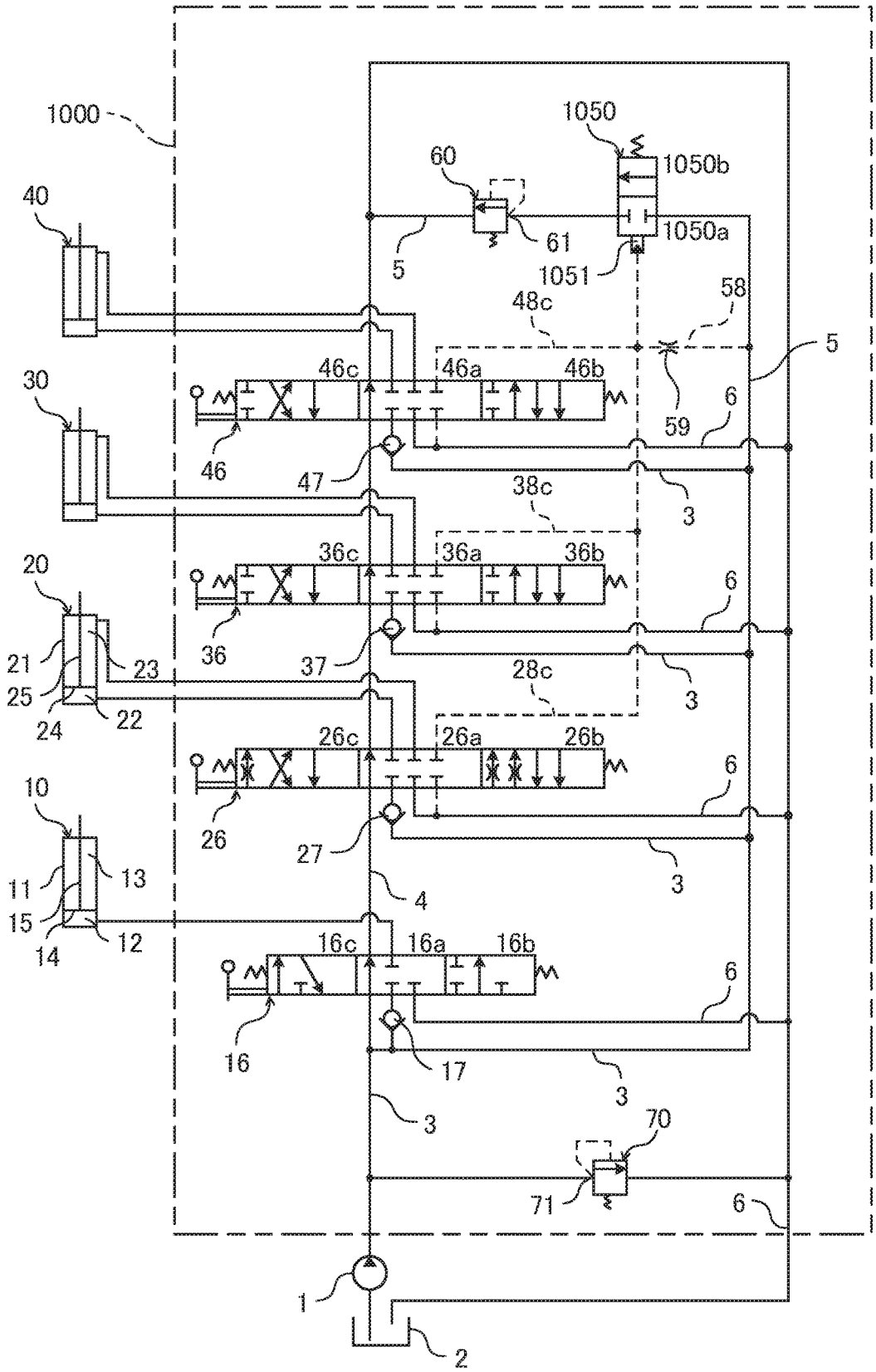
FIG. 13 is a hydraulic circuit diagram of a fluid pressure control device according to a tenth embodiment of the present invention.

As shown in FIG. 13, in the fluid pressure control device 1000, a switching valve 1050 is switched to a blocking position 1050*a* at the time of supplying the working oil to a pilot chamber 1051, and switched to a communication position 1050*b* at the time of discharging the working oil from the pilot chamber 1051. The pilot chamber 1051 is connected to a branching passage 5 on the upstream side of the switching valve 1050 through a pilot passage 58. A throttle 59 is provided in the pilot passage 58.

Discharge passages 28*c*, 38*c*, 48*c* are connected to the pilot chamber 1051. The discharge passage 28*c* is connected to a discharge passage 6 via a second control valve 26, the discharge passage 38*c* is connected to the discharge passage 6 via a second control valve 36, and the discharge passage 48*c* is connected to the discharge passage 6 via a second control valve 46.

In a case where the second control valve 26 is at a neutral position 26*a*, the second control valve 26 blocks a flow of the working oil in the discharge passage 28*c*. In a case where the second control valve 26 is at an operating position 26*b* or 26*c*, the second control valve 26 allows the flow of the working oil in the discharge passage 28*c*. As well as the second control valve 26, in a case where the second control valves 36, 46 are at neutral positions 36*a*, 46*a*, the second control valves 36, 46 block flows of the working oil in the discharge passages 38*c*, 48*c*. In a case where the second control valves 36, 46 are at operating positions 36*b* or 36*c*, 46*b* or 46*c*, the second control valves 36, 46 allow the flows of the working oil in the discharge passages 38*c*, 48*c*.

In a case where at least one of the second control valves 26, 36, 46 is at the operating position 26*b*, 26*c*, 36*b*, 36*c*, 46*b*, or 46*c*, the pilot chamber 1051 communicates with the discharge passage 6 through at least one of the discharge passages 28*c*, 38*c*, 48*c*. Therefore, the working oil in the pilot chamber 1051 is discharged to a tank 2 through at least one of the discharge passages 28*c*, 38*c*, 48*c* and the discharge passage 6.

Since the working oil is discharged from the pilot chamber 1051, the switching valve 1050 is switched to the communication position 1050*b*, and a flow of the working oil in the branching passage 5 is allowed. As a result, a flow of the working oil to a first relief valve 60 is allowed. Since the branching passage 5 communicates with a supply passage 3, the pressure in the branching passage 5 and the supply passage 3 is restricted to be a first pressure limit value or lower by the first relief valve 60.

In a case where all the second control valves 26, 36, 46 are at the neutral positions 26*a*, 36*a*, 46*a*, the flows of the working oil in the discharge passages 28*c*, 38*c*, 48*c* are blocked. That is, discharge of the working fluid from the pilot chamber 1051 is blocked. Since the pilot chamber 1051 is connected to a pump 1 through the pilot passage 58, the branching passage 5, and the supply passage 3, the working oil is supplied to the pilot chamber 1051. As a result, the switching valve 1050 is switched to the blocking position 1050*a*.

Since the switching valve 1050 is switched to the blocking position 1050*a*, the flow of the working oil in the branching passage 5 is blocked. That is, the working oil does not flow to the first relief valve 60, and the pressure in the branching passage 5 and the supply passage 3 is not restricted by the first pressure limit value.

Next, operation of the fluid pressure control device 1000 will be described.

Firstly, a case where at least one of the second control valves 26, 36, 46 is at the operating position 26*b*, 26*c*, 36*b*, 36*c*, 46*b*, or 46*c* will be described.

In a case where the second control valve 26 is at the operating position 26*b* or 26*c*, the second control valve 26 allows the flow of the working oil in the discharge passage 28*c*. Therefore, the pilot chamber 1051 communicates with the tank 2 through the discharge passage 28*c* and the discharge passage 6.

The working oil in the pilot chamber 1051 is discharged to the tank 2 through the discharge passage 28*c* and the discharge passage 6. As a result, the switching valve 1050 is switched to the communication position 1050*b*. The switching valve 1050 allows the flow of the working oil in the branching passage 5, and the flow of the working oil to the first relief valve 60 is allowed.

Since the branching passage 5 communicates with the supply passage 3, the first relief valve 60 restricts the pressure in the branching passage 5 and the supply passage 3 to the first pressure limit value or lower. Therefore, even when the second control valve 26 is at the operating position 26*b* or 26*c* and a tilt cylinder 20 communicates with the supply passage 3, the pressure exceeding the first pressure limit value can be prevented from acting on the tilt cylinder 20.

By setting the first pressure limit value to a pressure upper limit value of the tilt cylinder 20 or lower, the pressure exceeding the pressure upper limit value of the tilt cylinder 20 does not act on the tilt cylinder 20. As a result, damage to the tilt cylinder 20 can be prevented.

In such a way, in the present embodiment, in a case where the second control valve 26 allows a flow of the working oil from the supply passage 3 to the tilt cylinder 20, the working oil is discharged from the pilot chamber 1051. Therefore, the switching valve 1050 is switched to the communication position 1050*b*. The flow of the working oil to the first relief valve 60 is allowed by the switching valve 1050, and the pressure in the branching passage 5 and the supply passage 3 is restricted to be the first pressure limit value or lower by the first relief valve 60. Therefore, the pressure exceeding the first pressure limit value can be prevented from acting on the tilt cylinder 20.

In a case where the second control valves 36, 46 are at the operating positions 36*b* or 36*c*, 46*b* or 46*c*, as well as a case where the second control valve 26 is at the operating position 26*b* or 26*c*, the pressure exceeding the first pressure limit value can be prevented from acting on attached equipment actuators 30, 40. Therefore, damage to the attached equipment actuators 30, 40 can be prevented.

The pressure in the supply passage 3 is restricted to be the first pressure limit value or lower irrespective of a position of a first control valve 16. Therefore, even in a case where a high pressure actuator 10 and at least one of the low pressure actuators 20, 30, 40 are actuated, the pressure exceeding the first pressure limit value can be prevented from acting on the low pressure actuators 20, 30, 40.

Next, a case where all the second control valves 26, 36, 46 are at the neutral positions 26*a*, 36*a*, 46*a* will be described.

In a case where the second control valve 26 is at the neutral position 26*a*, the second control valve 26 blocks the flow of the working oil in the discharge passage 28*c*. Therefore, the discharge of the working oil from the pilot chamber 1051 is blocked. In a case where the second control valves 36, 46 are at the neutral positions 36*a*, 46*a*, the discharge of the working oil from the pilot chamber 1051 is blocked as well as the second control valve 26.

Since the working oil discharged from the pump 1 is supplied to the pilot chamber 1051 through the supply passage 3, the branching passage 5, and the pilot passage 38, the switching valve 1050 is switched to the blocking position 1050*a*. As a result, the flow of the working oil to the first relief valve 60 is blocked.

Since the flow of the working oil to the first relief valve 60 is blocked, the pressure in the supply passage 3 is not restricted by the first pressure limit value. That is, the pressure of the supply passage 3 can be increased more than the first pressure limit value. Therefore, when the first control valve 16 is switched to a lifting position 16*b* and the lift cylinder 10 is extended, the pressure exceeding the first pressure limit value can act on the lift cylinder 10.

A flow of the working oil from the supply passage 3 to a second relief valve 70 is not blocked irrespective of the positions of the first and second control valves 16, 26, 36, 46. Therefore, the pressure in the supply passage 3 is restricted to be a second pressure limit value or lower. Even when the lift cylinder 10 communicates with the supply passage 3, the pressure exceeding the second pressure limit value can be prevented from acting on the lift cylinder 10.

In such a way, in the present embodiment, the second relief valve 70 is provided on the upstream side of the switching valve 1050. Thus, the pressure in the supply passage 3 is restricted to be the second pressure limit value or lower by the second relief valve 70. Therefore, even in a case where the first relief valve 60 does not restrict the pressure in the supply passage 3, the pressure of the second pressure limit value or higher can be prevented from acting on the lift cylinder 10.

By setting the second pressure limit value to a pressure upper limit value of the lift cylinder 10 or lower, the pressure exceeding the pressure upper limit value of the lift cylinder 10 does not act on the lift cylinder 10. As a result, damage to the lift cylinder 10 can be prevented.

In the example shown in FIG. 13, the second relief valve 70 is provided on the upstream side of the switching valve 1050. However, as in the second embodiment (see FIG. 4), the second relief valve 70 may be provided in the branching passage 5 on the downstream side of a switching valve 250. In this case, the switching valve 250 is a three-port two-position switching valve having a first communication position 250*a* at which the working oil in the branching passage 5 is guided to the first relief valve 60, and a second communication position 250*b* at which the flow of the working oil in the branching passage 5 is guided to the second relief valve 70 (see FIG. 4).

In addition, as in the third embodiment (see FIG. 5), an unloading valve 80 may be provided in the branching passage 5 on the upstream side of the switching valve 250.

Further, electromagnetic proportional switching valves may be used as the first and second control valves 16, 26, 36, 46 as in the ninth embodiment (see FIG. 12).

According to the above tenth embodiment, as well as the first embodiment, the fluid pressure control device 1000 can be more downsized. In addition, the pressure exceeding the first pressure limit value can be prevented from acting on the low pressure actuators 20, 30, 40. Further, the pressure exceeding the second pressure limit value can be prevented from acting on the high pressure actuator 10.

Hereinafter, the configurations, the acts, and the effects of the embodiments of the present invention will be summarized.

In the present embodiments, the fluid pressure control device 100, 200, 300, 400, 500, 600, 700, 800, 900 includes the supply passage 3, the first control valve 16, 916, the second control valve 26, 526, 726, 926, the branching passage 5, the switching valve 50, 250, and the first relief valve 60. The working oil (working fluid) discharged from the pump (pressurization portion) 1 is guided to the lift cylinder (high pressure actuator) 10 and the tilt cylinder (low pressure actuator) 20 through the supply passage 3. The first control valve 16, 916 is provided in the supply passage 3 and controls operation of the lift cylinder 10. The second control valve 26, 526, 726, 926 is provided in the supply passage 3 and controls operation of the tilt cylinder 20. The branching passage 5 branches from the supply passage 3 on the upstream side of the second control valve 26, 526, 726, 926 and goes around the second control valve 26, 526, 726, 926. The switching valve 50, 250 is provided in the branching passage 5 and has the pilot chamber 51, 251 to which the working oil is supplied from the supply passage 3 through the second control valve 26, 526, 726, 926. The first relief valve 60 is provided in the branching passage 5 on the downstream side of the switching valve 50, 250. The second control valve 26, 526, 726, 926 allows the supply of the working oil from the supply passage 3 to the pilot chamber 51, 251 in a case where the flow of the working oil to the tilt cylinder 20 is allowed, and blocks the supply of the working oil from the supply passage 3 to the pilot chamber 51, 251 in a case where the flow of the working oil to the tilt cylinder 20 is blocked. The switching valve 50, 250 allows the flow of the working oil to the first relief valve 60 in a case where the working oil is supplied to the pilot chamber 51, 251, and blocks the flow of the working oil to the first relief valve 60 in a case where the supply of the working oil to the pilot chamber 51, 251 is blocked. The first relief valve 60 restricts the pressure in the branching passage 5 to the first pressure limit value or lower in a case where the flow of the working oil to the first relief valve 60 is allowed.

With this configuration, the first relief valve 60 is provided in the branching passage 5. Thus, there is no need for forming a flow passage from the supply passage 3 to the first relief valve 60 in the second control valve 26, 526, 726, 926. The flow passage from the supply passage 3 to the pilot chamber 51, 251 through the second control valve 26, 526, 726, 926 is only required to be able to flow the amount of the working oil corresponding to the volume of the pilot chamber 51, 251. Thus, the flow passage may be thin, so that the second control valve 26, 526, 726, 926 can be downsized. In a case where the second control valve 26, 526, 726, 926 allows the flow of the working oil to the tilt cylinder 20, the second control valve 26, 526, 726, 926 allows the supply of the working oil to the pilot chamber 51, 251. Thus, the working oil is supplied to the pilot chamber 51, 251, and the switching valve 50, 250 allows the flow of the working oil to the first relief valve 60. Since the first relief valve 60 restricts the pressure in the branching passage 5 to the first pressure limit value or lower, the pressure in the supply passage 3 is restricted to be the first pressure limit value or lower. Therefore, without acting the pressure of the first pressure limit value or higher on the tilt cylinder 20, the fluid pressure control device 100, 200, 300, 400, 500, 600, 700, 800, 900 that controls the operation of the lift cylinder 10 and the tilt cylinder 20 can be more downsized.

In the present embodiments, the fluid pressure control device 100, 400, 500, 600, 700, 800, 900 further includes the second relief valve 70 that is provided on the upstream side of the switching valve 50 and restricts the pressure in the supply passage 3 to the second pressure limit value or lower which is higher than the first pressure limit value.

With this configuration, the second relief valve 70 is provided on the upstream side of the switching valve 50. Thus, the pressure in the supply passage 3 is restricted to be the second pressure limit value or lower irrespective of a state of the switching valve 50. Therefore, even in a case where the first relief valve 60 does not restrict the pressure in the supply passage 3, the pressure of the second pressure limit value or higher can be prevented from acting on the lift cylinder 10.

In the present embodiments, the fluid pressure control device 200, 300 further includes the second relief valve 70 that is provided in the branching passage 5 on the downstream side of the switching valve 250 and restricts the pressure in the branching passage 5 to the second pressure limit value or lower which is higher than the first pressure limit value. The switching valve 250 guides the working oil to the first relief valve 60 and blocks the flow of the working oil to the second relief valve 70 in a case where the working oil is supplied to the pilot chamber 251, and blocks the flow of the working oil to the first relief valve 60 and guides the working oil to the second relief valve 70 in a case where the supply of the working oil to the pilot chamber 251 is blocked.

With this configuration, both the first and second relief valves 60, 70 are provided in the branching passage 5. Thus, there is no need for providing a flow passage from the supply passage 3 to the second relief valve 70 separately from the branching passage 5. Since the switching valve 250 switches the direction of the flow of the working oil, the pressure in the supply passage 3 is restricted to be the first or second pressure limit value or lower. Therefore, while preventing the pressure exceeding the first pressure limit value from acting on the tilt cylinder 20 and preventing the pressure exceeding the second pressure limit value from acting on the lift cylinder 10, the fluid pressure control device 200, 300 can be more downsized.

In the present embodiments, the fluid pressure control device 300 further includes the unloading valve 80 that is provided in the branching passage 5 on the upstream side of the switching valve 250 and guides the working oil from the branching passage 5 to the discharge passage 6 while going around the switching valve 250 at the time of valve open. The unloading valve 80 has the valve body 81 that allows or blocks the flow of the working oil from the branching passage 5 to the discharge passage 6, and the back pressure chamber 82 that is provided facing the back surface of the valve body 81 and communicates with the switching valve 250 so that the working oil of the supply passage 3 is guided to the back pressure chamber 82 through the throttle 84. The valve body 81 is opened/closed in accordance with the pressure in the back pressure chamber 82.

With this configuration, since the valve body 81 is opened/closed in accordance with the pressure in the back pressure chamber 82, the part of the branching passage 5 on the downstream side of the unloading valve 80 is only required to be able to transmit the pressure in the first and second relief valves 60, 70 to the back pressure chamber 82. Thus, the area of the flow passage may be small. The unloading valve 80 guides the working oil from the branching passage 5 to the discharge passage 6 while going around the switching valve 250 at the time of valve open. The working oil guided from the supply passage 3 to the branching passage 5 is discharged to the tank 2 mainly through the discharge passages 6*a*, 6 at the time of valve open of the unloading valve 80. Thus, the area of the flow passage in the part of the branching passage 5 on the downstream side of the unloading valve 80 may be small. Therefore, the fluid pressure control device 300 can be more downsized.

In the present embodiments, the fluid pressure control device 800, 900 further includes at least two second control valves 26, 36, the pilot passage 28, the pilot passage 38, the shuttle valve 54. The pilot passage 28 is connected to the supply passage 3 in a case where the second control valve 26 allows the flow of the working oil to the tilt cylinder 20. The pilot passage 38 is connected to the supply passage 3 in a case where the second control valve 36 allows the flow of the working oil to the attached equipment actuator 30. The shuttle valve 54 is connected to the pilot passages 28, 38 and connected to the pilot chamber 51. The shuttle valve 54 allows the pilot passage 28, 38 with higher pressure to communicate with the pilot chamber 51 and blocks the flow of the working oil in the other pilot passage.

With this configuration, for example in a case where the pressure in the pilot passage 28 is higher than the pressure in the pilot passage 38, the shuttle valve 54 blocks a flow of the working oil in the pilot passage 38. Therefore, the working oil in the pilot passage 28 does not easily flow to other passages (such as the bypass passage 4 and the discharge passage 6) through the pilot passage 38. Therefore, the working oil in the pilot passage 28 can be more reliably supplied to the pilot chamber 51, so that the pressure exceeding the first pressure limit value can be more reliably prevented from acting on the tilt cylinder 20.

In the present embodiments, the fluid pressure control device 1000 includes the supply passage 3, the first control valve 16, the second control valve 26, the branching passage 5, the switching valve 1050, and the first relief valve 60. The supply passage 3 guides the working oil discharged from the pump 1 to the lift cylinder 10 and the tilt cylinder 20. The first control valve 16 is provided in the supply passage 3 and controls the operation of the lift cylinder 10. The second control valve 26 is provided in the supply passage 3 and controls the operation of the tilt cylinder 20. The branching passage 5 branches from the supply passage 3 on the upstream side of the second control valve 26 and goes around the second control valve 26. The switching valve 1050 is provided in the branching passage 5 and has the pilot chamber 1051 to which the working oil is supplied from the supply passage 3 while going around the second control valve 26. The first relief valve 60 is provided in the branching passage 5 on the downstream side of the switching valve 1050. The second control valve 26 allows the discharge of the working oil from the pilot chamber 1051 in a case where the flow of the working oil to the tilt cylinder 20 is allowed, and blocks the discharge of the working oil from the pilot chamber 1051 in a case where the flow of the working oil to the tilt cylinder 20 is blocked. The switching valve 1050 blocks the flow of the working oil to the first relief valve 60 in a case where the discharge of the working oil from the pilot chamber 1051 is blocked, and allows the flow of the working oil to the first relief valve 60 in a case where the working oil is discharged from the pilot chamber 1051. The first relief valve 60 restricts the pressure in the branching passage 5 to the first pressure limit value or lower in a case where the flow of the working oil to the first relief valve 60 is allowed.

With this configuration, the first relief valve 60 is provided in the branching passage 5. Thus, there is no need for forming a flow passage from the supply passage 3 to the first relief valve 60 in the second control valve 26. The flow passage from the pilot chamber 1051 to the discharge passage 6 through the second control valve 26 is only required to be able to flow the amount of the working oil corresponding to the volume of the pilot chamber 1051. Thus, the flow passage may be thin, so that the second control valve 26 can be downsized. In a case where the second control valve 26 allows the flow of the working oil to the tilt cylinder 20, the second control valve 26 allows the discharge of the working oil from the pilot chamber 1051. Thus, the working oil is discharged from the pilot chamber 1051, and the switching valve 1050 allows the flow of the working oil to the first relief valve 60. Since the first relief valve 60 restricts the pressure in the branching passage 5 to the first pressure limit value or lower, the pressure in the supply passage 3 is restricted to be the first pressure limit value or lower. Therefore, without letting the pressure of the first pressure limit value or higher act on the tilt cylinder 20, the fluid pressure control device 1000 that controls the work of the lift cylinder 10 and the tilt cylinder 20 can be more downsized.

The embodiments of the present invention described above are merely illustration of some application examples of the present invention and not of the nature to limit the technical scope of the present invention to the specific constructions of the above embodiments.

The present application claims a priority based on Japanese Patent Application No. 2015-48660 filed with the Japan Patent Office on Mar. 11, 2015, all the contents of which are hereby incorporated by reference.

The invention claimed is:

1. A fluid pressure control device, comprising:

a supply passage through which a working fluid discharged from a pressurization portion is guided to a high pressure actuator and a low pressure actuator;

a first control valve provided in the supply passage and configured to control work of the high pressure actuator;

a second control valve provided in the supply passage and is configured to control work of the low pressure actuator;

a branching passage branching from the supply passage on the upstream side of the second control valve and fluidly bypassing the second control valve;

a switching valve provided in the branching passage, the switching valve having a pilot chamber to which the working fluid is supplied from the supply passage through only the second control valve; and a first relief valve provided in the branching passage on the downstream side of the switching valve, wherein the second control valve allows supply of the working fluid from the supply passage to the pilot chamber in a case where a flow of the working fluid to the low pressure actuator is allowed, and blocks the supply of the working fluid from the supply passage to the pilot chamber in a case where the flow of the working fluid to the low pressure actuator is blocked, the switching valve allows a flow of the working fluid to the first relief valve in a case where the working fluid is supplied to the pilot chamber, and blocks the flow of the working fluid to the first relief valve in a case where the supply of the working fluid to the pilot chamber is blocked, and the first relief valve restricts pressure in the branching passage equal to or lower than a first pressure limit value in a case where the flow of the working fluid to the first relief valve is allowed.

2. The fluid pressure control device according to claim 1, further comprising a second relief valve provided on the upstream side of the switching valve and configured to restrict pressure in the supply passage equal to or lower than a second pressure limit value which is higher than the first pressure limit value.

3. The fluid pressure control device according to claim 2, wherein:

an additional low pressure actuator to which the working fluid discharged from the pressurization portion is guided through the supply passage;

an additional second control valve that is provided in the supply passage and is configured to control work of the additional low pressure actuator;

a first pilot passage to be connected to the supply passage in a case where one of the second control valves allows the flow of the working fluid to a corresponding one of the low pressure actuators;

a second pilot passage to be connected to the supply passage in a case where another one of the second control valves allows the flow of the working fluid to a corresponding one of the low pressure actuators; and a higher pressure selection valve connected to the first and second pilot passages and connected to the pilot chamber, the higher pressure selection valve being configured to provide communication between the pilot passage of higher pressure among the first and second pilot passages and the pilot chamber, the higher pressure selection valve being configured to block a flow of the working fluid in the other pilot passage.

4. The fluid pressure control device according to claim 1, further comprising:

an additional low pressure actuator to which the working fluid discharged from the pressurization portion is guided through the supply passage;

an additional second control valve that is provided in the supply passage and is configured to control work of the additional low pressure actuator;

a first pilot passage to be connected to the supply passage in a case where one of the second control valves allows the flow of the working fluid to a corresponding one of the low pressure actuators;

a second pilot passage to be connected to the supply passage in a case where another one of the second control valves allows the flow of the working fluid to a corresponding one of the low pressure actuators; and a higher pressure selection valve connected to the first and second pilot passages and connected to the pilot chamber, the higher pressure selection valve being configured to provide communication between the pilot passage of higher pressure among the first and second pilot passages and the pilot chamber, the higher pressure selection valve being configured to block a flow of the working fluid in the other pilot passage.

5. A fluid pressure control device, comprising:

a supply passage through which a working fluid discharged from a pressurization portion is guided to a high pressure actuator and a low pressure actuator;

a first control valve provided in the supply passage and configured to control work of the high pressure actuator;

a second control valve provided in the supply passage and is configured to control work of the low pressure actuator;

a branching passage branching from the supply passage on the upstream side of the second control valve and fluidly bypassing the second control valve;

a switching valve provided in the branching passage, the switching valve having a pilot chamber to which the working fluid is supplied from the supply passage through only the second control valve; and a first relief valve provided in the branching passage on the downstream side of the switching valve; and a second relief valve provided in the branching passage on the downstream side of the switching valve and configured to restrict the pressure in the branching passage equal to or lower than a second pressure limit value which is higher than the first pressure limit value, wherein the second control valve allows supply of the working fluid from the supply passage to the pilot chamber in a case where a flow of the working fluid to the low pressure actuator is allowed, and blocks the supply of the working fluid from the supply passage to the pilot chamber in a case where the flow of the working fluid to the low pressure actuator is blocked, the switching valve allows a flow of the working fluid to the first relief valve in a case where the working fluid is supplied to the pilot chamber, and blocks the flow of the working fluid to the first relief valve in a case where the supply of the working fluid to the pilot chamber is blocked, the first relief valve restricts pressure in the branching passage equal to or lower than a first pressure limit value in a case where the flow of the working fluid to the first relief valve is allowed, and the switching valve guides the working fluid to the first relief valve and blocks a flow of the working fluid to the second relief valve in a case where the working fluid is supplied to the pilot chamber, and blocks the flow of the working fluid to the first relief valve and guides the working fluid to the second relief valve in a case where the supply of the working fluid to the pilot chamber is blocked.

6. The fluid pressure control device according to claim 5, further comprising an unloading valve provided in the branching passage on the upstream side of the switching valve and configured to guide the working fluid from the branching passage to the tank by fluidly bypassing the switching valve when the unloading valve opens, wherein the unloading valve has a valve body configured to allow or block a flow of the working fluid from the branching passage to the discharge passage, and a back pressure chamber provided facing a back surface of the valve body, the back pressure chamber to which the working fluid of the supply passage is guided through a throttle, the back pressure chamber communicating with the switching valve, and the valve body is opened/closed in accordance with pressure in the back pressure chamber.

7. The fluid pressure control device according to claim 6, wherein:

an additional low pressure actuator to which the working fluid discharged from the pressurization portion is guided through the supply passage;

an additional second control valve that is provided in the supply passage and is configured to control work of the additional low pressure actuator;

a first pilot passage to be connected to the supply passage in a case where one of the second control valves allows the flow of the working fluid to a corresponding one of the low pressure actuators;

a second pilot passage to be connected to the supply passage in a case where another one of the second control valves allows the flow of the working fluid to a corresponding one of the low pressure actuators; and a higher pressure selection valve connected to the first and second pilot passages and connected to the pilot chamber, the higher pressure selection valve being configured to provide communication between the pilot passage of higher pressure among the first and second pilot passages and the pilot chamber, the higher pressure selection valve being configured to block a flow of the working fluid in the other pilot passage.

8. The fluid pressure control device according to claim 5, wherein:

an additional low pressure actuator to which the working fluid discharged from the pressurization portion is guided through the supply passage;

an additional second control valve that is provided in the supply passage and is configured to control work of the additional low pressure actuator;

a first pilot passage to be connected to the supply passage in a case where one of the second control valves allows the flow of the working fluid to a corresponding one of the low pressure actuators;

a second pilot passage to be connected to the supply passage in a case where another one of the second control valves allows the flow of the working fluid to a corresponding one of the low pressure actuators; and a higher pressure selection valve connected to the first and second pilot passages and connected to the pilot chamber, the higher pressure selection valve being configured to provide communication between the pilot passage of higher pressure among the first and second pilot passages and the pilot chamber, the higher pressure selection valve being configured to block a flow of the working fluid in the other pilot passage.

9. A fluid pressure control device, comprising:

a supply passage through which a working fluid discharged from a pressurization portion is guided to a high pressure actuator and a low pressure actuator;

a first control valve provided in the supply passage and configured to control work of the high pressure actuator;

a second control valve provided in the supply passage and configured to control work of the low pressure actuator;

a branching passage branching from the supply passage on the upstream side of the second control valve and fluidly bypassing the second control valve;

a switching valve provided in the branching passage, the switching valve having a pilot chamber to which the working fluid is supplied from the supply passage by fluidly bypassing the second control valve; and a relief valve provided in the branching passage on the downstream side of the switching valve, wherein the second control valve allows discharge of the working fluid from the pilot chamber in a case where a flow of the working fluid to the low pressure actuator is allowed, and blocks the discharge of the working fluid from the pilot chamber in a case where the flow of the working fluid to the low pressure actuator is blocked, the switching valve blocks a flow of the working fluid to the relief valve in a case where the discharge of the working fluid from the pilot chamber is blocked, and allows the flow of the working fluid to the relief valve in a case where the working fluid is discharged from the pilot chamber, and the relief valve restricts pressure in the branching passage to a pressure limit value or lower in a case where the flow of the working fluid to the relief valve is allowed.

* * * * *